US012135022B2

(12) United States Patent
Suzuki et al.

(10) Patent No.: US 12,135,022 B2
(45) Date of Patent: Nov. 5, 2024

(54) FLUID CONTROL APPARATUS AND ELECTRONIC APPARATUS

(71) Applicant: Sony Group Corporation, Tokyo (JP)

(72) Inventors: Hiroshi Suzuki, Tokyo (JP); Masahiro Sato, Tokyo (JP); Koji Fukumoto, Tokyo (JP); Yuya Horiuchi, Tokyo (JP); Hironobu Abe, Tokyo (JP); Hiroto Kawaguchi, Tokyo (JP); Kazuhiro Hongo, Tokyo (JP); Takuma Matsushita, Tokyo (JP); Daisuke Mizuta, Tokyo (JP); Kentaro Yoshida, Tokyo (JP)

(73) Assignee: Sony Group Corporation, Tokyo (JP)

( * ) Notice: Subject to any disclaimer, the term of this patent is extended or adjusted under 35 U.S.C. 154(b) by 266 days.

(21) Appl. No.: 17/616,381

(22) PCT Filed: May 19, 2020

(86) PCT No.: PCT/JP2020/019821
§ 371 (c)(1),
(2) Date: Dec. 3, 2021

(87) PCT Pub. No.: WO2020/246232
PCT Pub. Date: Dec. 10, 2020

(65) Prior Publication Data

US 2022/0260067 A1 Aug. 18, 2022

(30) Foreign Application Priority Data

Jun. 3, 2019 (JP) ..... 2019-103467

(51) Int. Cl.
*F04B 43/04* (2006.01)

(52) U.S. Cl.
CPC ..... *F04B 43/046* (2013.01)

(58) Field of Classification Search
CPC ..... F04B 43/046
See application file for complete search history.

(56) References Cited

U.S. PATENT DOCUMENTS 5,718,567 A * 2/1998 Rapp ..... F04B 43/043 417/479
6,629,820 B2 * 10/2003 Kornelsen ..... F16K 99/0034 137/833

(Continued)

FOREIGN PATENT DOCUMENTS

CN 105822527 A 8/2016
GB 2248891 A 4/1992

(Continued)

*Primary Examiner* — Thomas Fink
(74) *Attorney, Agent, or Firm* — K&L Gates LLP

(57) ABSTRACT

[Object] To provide a fluid control apparatus having a diaphragm structure and small flow path resistance.
[Solving Means] A fluid control apparatus according to the present technology includes a first space, two flat plate members, a drive mechanism, a second space, a first check valve, and a second check valve. The first space has an inlet and an outlet. The two flat plate members face each other via the first space, and at least one of the flat plate members is an elastic body having flexibility. The drive mechanism bends the elastic body. The second space adjoins the first space, communicates with the first space via the inlet, and has a suction port. The first check valve allows fluid to flow from the suction port to the first space via the inlet. The third space adjoins the first space, communicates with the first space via the outlet, and has a discharge port. The second check valve allows the fluid to flow from the first space to the discharge port via the outlet. At least one of the suction port and the discharge port is positioned on an extension surface of at least one of the two flat plate members.

24 Claims, 29 Drawing Sheets

(56) References Cited

U.S. PATENT DOCUMENTS

| | | | | |
|---|---|---|---|---|
| 8,066,494 | B2 * | 11/2011 | Kamitani | F04B 43/046 417/413.2 |
| 9,157,428 | B2 * | 10/2015 | Kim | B01L 3/50273 |
| 2002/0197167 | A1 | 12/2002 | Kornelsen | |
| 2005/0074340 | A1 * | 4/2005 | Xu | F04B 43/06 417/395 |
| 2009/0214362 | A1 | 8/2009 | Kanai | |
| 2009/0232684 | A1 * | 9/2009 | Hirata | F04B 43/046 417/413.2 |
| 2013/0058818 | A1 * | 3/2013 | Hirata | F04B 45/047 417/479 |
| 2014/0178223 | A1 * | 6/2014 | Kim | F04B 43/046 417/437 |
| 2014/0294629 | A1 * | 10/2014 | Kim | F04B 43/046 417/480 |
| 2022/0372965 | A1 * | 11/2022 | Kawaguchi | F04B 43/046 |

FOREIGN PATENT DOCUMENTS

| | | | |
|---|---|---|---|
| JP | S59221485 | A | 12/1984 |
| JP | S62-070677 | A | 4/1987 |
| JP | H051669 | A | 1/1993 |
| JP | 10502861 | A | 3/1998 |
| JP | H10-184549 | A | 7/1998 |
| JP | H11-311184 | A | 11/1999 |
| JP | 2000265963 | A | 9/2000 |
| JP | 2002227770 | A | 8/2002 |
| JP | 2006295147 | A | 10/2006 |
| JP | 2007507663 | A | 3/2007 |
| JP | 2007162525 | A | 6/2007 |
| JP | 2008163902 | A | 7/2008 |
| JP | 2009293626 | A | 12/2009 |
| JP | 2012528980 | A | 11/2012 |
| JP | 2019065708 | A | 4/2019 |
| WO | WO-2005/012729 | A1 | 2/2005 |
| WO | WO-2018033347 | A1 | 2/2018 |

* cited by examiner (a)

(b)

FLUID CONTROL APPARATUS AND ELECTRONIC APPARATUS

TECHNICAL FIELD

The present technology relates to a fluid control apparatus and an electronic apparatus for transporting fluid by driving a diaphragm.

BACKGROUND ART

As a small and thin pump, a diaphragm type pump using a diaphragm is practically used. The diaphragm type pump is equipped with a pump chamber in which a volume is varied by bending deformation of the diaphragm, and can suck fluid into the pump chamber by increasing the volume and discharge the fluid from the pump chamber by decreasing the volume.

Generally, a suction port and a discharge port connected to the pump chamber are provided in a direction perpendicular to the diaphragm. For example, Patent Literature 1 discloses a piezoelectric pump in which a fluid suction port and a fluid discharge port are provided in a direction perpendicular to a vibrator.

CITATION LIST

Patent Literature

Patent Literature 1: Japanese Patent Application Laid-open No. Hei7-301182

DISCLOSURE OF INVENTION

Technical Problem

However, in a case where the suction port and the discharge port are provided in the direction perpendicular to the diaphragm as described in Patent Literature 1, there is a problem that a cross-sectional shape of a flow path changes greatly among the pump chamber and the suction port and the discharge port, and flow path resistance increases.

In view of the above circumstances, an object of the present technology is to provide a fluid control apparatus having a diaphragm structure and small flow path resistance.

Solution to Problem

In order to achieve the above object, a fluid control apparatus according to the present technology includes a first space, two flat plate members, a drive mechanism, a second space, a first check valve, and a second check valve.

The first space has an inlet and an outlet.

The two flat plate members face each other via the first space, and at least one of the flat plate members is an elastic body having flexibility.

The drive mechanism bends the elastic body.

The second space adjoins the first space, communicates with the first space via the inlet, and has a suction port.

The first check valve allows fluid to flow from the suction port to the first space via the inlet.

The third space adjoins the first space, communicates with the first space via the outlet, and has a discharge port.

The second check valve allows the fluid to flow from the first space to the discharge port via the outlet.

At least one of the suction port and the discharge port is positioned on an extension surface of at least one of the two flat plate members.

To achieve the above object, an electronic apparatus according to the present technology includes a fluid control apparatus including a first space, two flat plate members, a drive mechanism, a second space, a first check valve, and a second check valve.

The first space has an inlet and an outlet.

The two flat plate members face each other via the first space, and at least one of the flat plate members is an elastic body having flexibility.

The drive mechanism bends the elastic body.

The second space adjoins the first space, communicates with the first space via the inlet, and has a suction port.

The first check valve allows fluid to flow from the suction port to the first space via the inlet.

The third space adjoins the first space, communicates with the first space via the outlet, and has a discharge port.

The second check valve allows the fluid to flow from the first space to the discharge port via the outlet.

At least one of the suction port and the discharge port is positioned on an extension surface of at least one of the two flat plate members.

BRIEF DESCRIPTION OF DRAWINGS

FIG. 6 FIG. 5 is a schematic diagram showing a fluid discharge operation of the fluid control apparatus according to the embodiment of the present technology.

MODE(S) FOR CARRYING OUT THE INVENTION

A fluid control apparatus according to an embodiment of the present technology will be described.

[Schematic Configuration of Fluid Control Apparatus]

Figure 1:
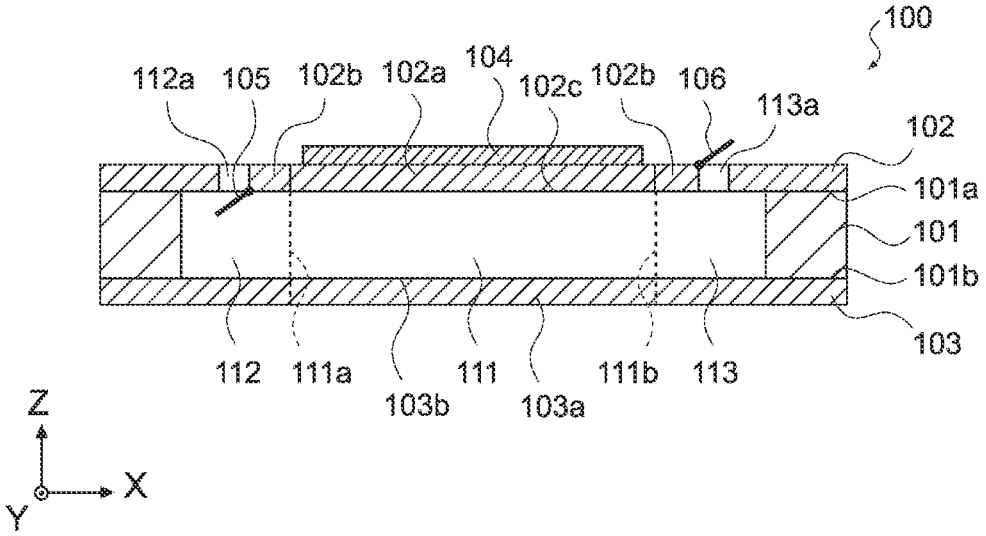
FIG. 1 is a cross-sectional diagram of a fluid control apparatus according to an embodiment of the present technology.
Figure 2:
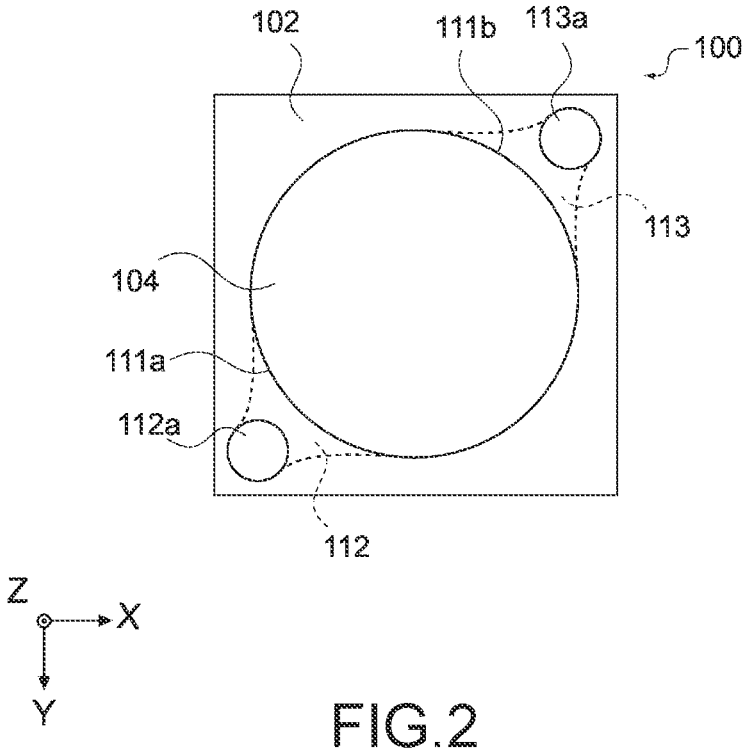
FIG. 2 is a plan diagram of the fluid control apparatus according to the embodiment of the present technology.

FIG. 1 is a cross-sectional diagram of a fluid control apparatus 100 according to the present embodiment, and FIG. 2 is a plan diagram of the fluid control apparatus 100. The fluid control apparatus 100 is a pump capable of sucking and discharging fluid. A fluid is a gas, a liquid, or other fluid, and the like, and is not particularly limited.

Figure 3:
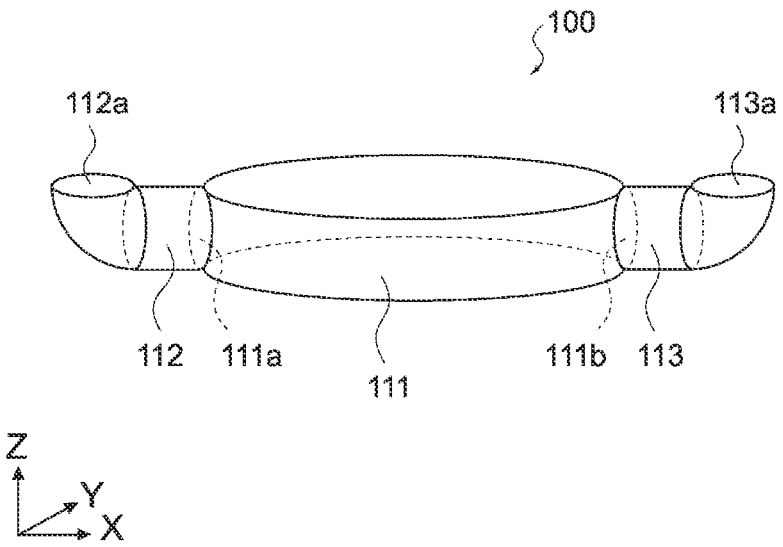
FIG. 3 is a schematic diagram showing a flow path included in the fluid control apparatus according to the embodiment of the present technology.

As shown in FIGS. 1 and 2, the fluid control apparatus 100 includes a first housing member 101, a second housing member 102, a third housing member 103, a drive mechanism 104, a first check valve 105, and a second check valve 106. Between the second housing member 102 and the third housing member 103, a first space 111 is provided, and a second space 112 and a third space 113 adjoined to the first space 111 are provided. FIG. 3 is a schematic diagram showing the first space 111, the second space 112, and the third space 113.

The first housing member 101, the second housing member 102, and the third housing member 103 are bonded and form the first space 111, the second space 112, and the third space 113. The first housing member 101 is a plate-shaped member in which opening is formed to be the first space 111, the second space 112, and the third space 113. One surface of the first housing member 101 is defined as a first surface 101*a*, and a surface opposite to the first surface 101*a* is defined as a second surface 101*b*.

The second housing member 102 is a plate-shaped member that is bonded to the first surface 101*a* of the first housing member 101. The second housing member 102 includes a movable portion 102*a* and a fixed portion 102*b*. The movable portion 102*a* is positioned at a central portion of the second housing member 102, and is made of an elastic body. The shape of the movable portion 102*a* is not particularly limited, but can be a circular shape viewed from a direction (Z direction) perpendicular to the second housing member 102 and the third housing member 103. The fixed portion 102*b* is arranged around the movable portion 102*a* and is made of an inelastic body. The movable portion 102*a* is a diaphragm, is supported by the fixed portion 102*b*, and is configured to be bent by the drive mechanism 104.

Figure 4:
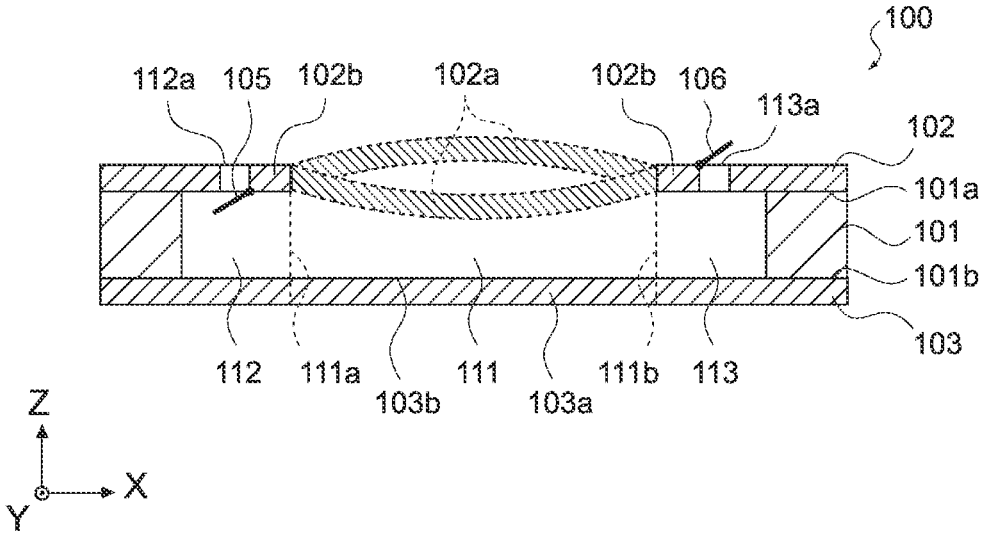
FIG. 4 is a schematic diagram showing an operation of a movable portion included in the fluid control apparatus according to the embodiment of the present technology.

FIG. 4 is a schematic diagram showing a bending operation of the movable portion 102*a*. In FIG. 4, the drive mechanism 104 is not shown. As shown in FIG. 4, the movable portion 102*a* bends in a direction approaching the third housing member 103 and in a direction away from the third housing member 103. A spring portion that promotes bending of the movable portion 102*a* may be provided between the movable portion 102*a* and the fixed portion 102*b*. This will be described in detail later. Hereinafter, the bending direction of the movable portion 102*a* is referred to as the Z direction, and two directions perpendicular to the Z direction and orthogonal to each other are referred to as the X direction and the Y direction. The X direction and the Y direction each is a direction parallel to each extension surface of the second housing member 102 and the third housing member 103.

The third housing member 103 is a plate-shaped member which is bonded to the second surface 101*b* of the first housing member 101. The third housing member 103 may be a plate-shaped member made of an inelastic body. A portion of the third housing member 103 facing the movable portion 102*a* is defined as a facing portion 103*a*. Note that the first housing member 101, the second housing member 102, and the third housing member 103 are together defined as a "housing" of the fluid control apparatus 100 in the following description.

As shown in FIG. 1, the second housing member 102 and the third housing member 103 are arranged such that the movable portion 102*a* and the facing portion 103*a* face each other via the first space 111. As shown in FIG. 4, the first space 111 is a space in which a volume is varied by bending the movable portion 102*a*, and includes an inlet 111*a* and an outlet 111*b*.

The second space 112 is a space adjoined to the first space 111, and communicates with the first space 111 via the inlet 111*a*. In addition, the second space 112 is provided with a suction port 112*a*. The suction port 112*a* is an opening provided in the second housing member 102, and the second space 112 communicates with an external space of the fluid control apparatus 100 via the suction port 112*a*. Incidentally, the suction port 112*a* may be connected with a pipe or the like for supplying the fluid to the suction port 112*a*.

The third space 113 is a space adjoined to the first space 111, and communicates with the first space 111 via the outlet 111*b*. In addition, the third space 113 has a discharge port 113*a*. The discharge port 113*a* is an opening provided in the second housing member 102, and the third space 113 communicates with the external space of the fluid control apparatus 100 via the discharge port 113*a*. The discharge port 113*a* may be connected to a pipe or the like into which the fluid discharged from the discharge port 113*a* flows.

The drive mechanism 104 bends the movable portion 102*a*. The drive mechanism 104 may be a piezoelectric element laminated on the movable portion 102*a* as shown in FIG. 1. The drive mechanism 104 may not be the piezoelectric element, and may be any mechanism capable of bending the movable portion 102*a*.

The first check valve 105 allows the fluid to flow into the first space 111 from the suction port 112*a* via the inlet 111*a*. As shown in FIG. 1, the first check valve 105 may be provided in the suction port 112*a* to allow the fluid flowing from the external space to the second space 112 to pass therethrough and prevent the fluid flowing from the second space 112 to the external space from passing therethrough.

In addition, the first check valve 105 may be provided in the inlet 111*a* to allow the fluid flowing from the second space 112 to the first space 111 to pass therethrough and prevent the fluid flowing from the first space 111 to the second space 112 from passing therethrough. The first check valve 105 may be, for example, a swing type check valve.

The second check valve 106 allows the fluid to flow from the first space 111 to the discharge port 113*a* via the outlet 111*b*. As shown in FIG. 1, the second check valve 106 may be provided at the discharge port 113*a* to allow the fluid flowing from the third space 113 to the external space to pass therethrough and prevent the fluid flowing from the external space to the third space 113 from passing therethrough.

In addition, the second check valve 106 may be provided at the outlet 111*b* to allow the fluid flowing from the first space 111 to the third space 113 to pass therethrough and prevent the fluid flowing from the third space 113 to the first space 111 from passing therethrough. The second check valve 106 may be, for example, a swing type check valve.

The fluid control apparatus 100 has the schematic configuration described above. Since the fluid control apparatus 100 has a configuration that the plate-shaped members (first housing member 101, second housing member 102, and third housing member 103) are laminated, thinning of the fluid control apparatus 100 is realized. The first housing member 101, the second housing member 102, and the third housing member 103 may be bonded by adhering, fastening, or other bonding methods. Although the third housing member 103 is the inelastic body in the above description, the third housing member 103 may also include the movable portion made of the elastic body similar to the second housing member 102, and the movable portion may be bent by the drive mechanism.

The shape of the housing (first housing member 101, second housing member 102, and third housing member 103) of the fluid control apparatus 100 is not particularly limited, but may be a quadrangular shape viewed from the direction (Z direction) perpendicular to the second housing member 102 and the third housing member 103 as shown in FIG. 2. Furthermore, the shape of the housing of the fluid control apparatus 100 is not limited to the quadrangular shape, and may be a polygon shape of hexagonal or octagonal shape or the like viewed from the same direction.

[Operation of Fluid Control Apparatus]

Figure 5:
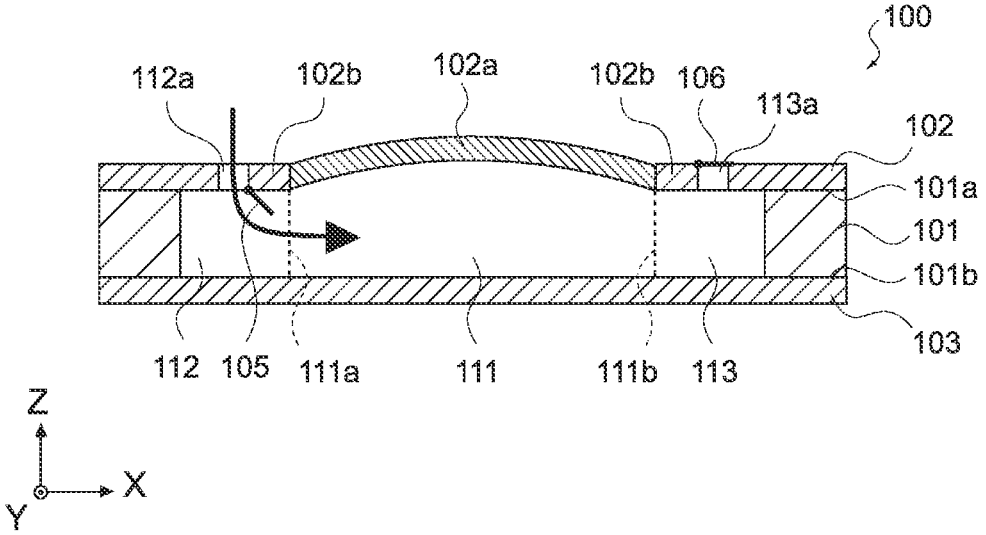
FIG. 5 is a schematic diagram showing a fluid suction operation of the fluid control apparatus according to the embodiment of the present technology.
Figure 6:
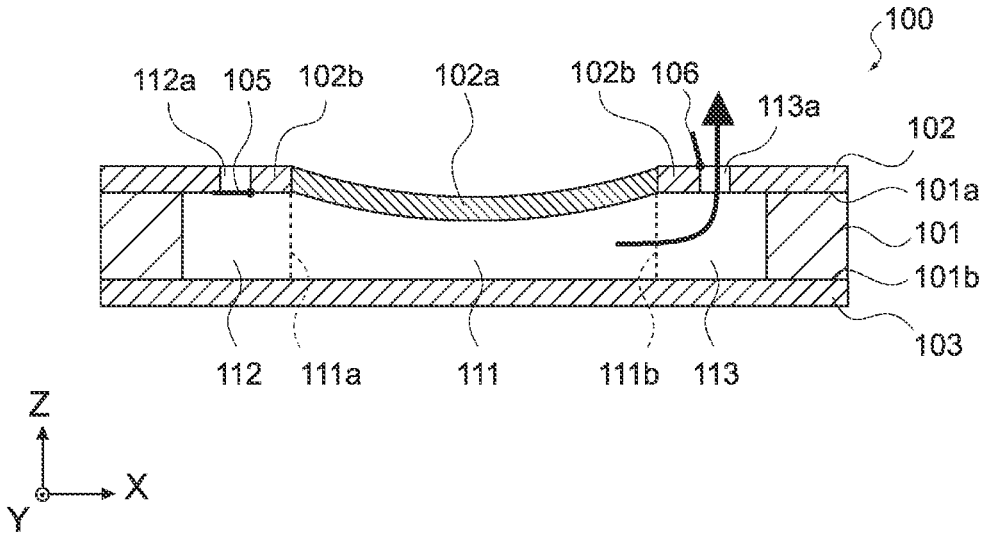

An operation of the fluid control apparatus 100 will be described. FIGS. 5 and 6 are schematic diagrams showing the operation of the fluid control apparatus 100.

As shown in FIG. 5, when the movable portion 102*a* bends in the direction away from the third housing member 103, the volume of the first space 111 increases. As a result, the fluid flows into the second space 112 via the inlet port 112*a* and flows into the first space 111 via the inlet 111*a*, as indicated by an arrow. At this time, the discharge port 113*a* is closed by the second check valve 106, and the fluid is prevented from flowing from the discharge port 113*a*.

As shown in FIG. 6, when the movable portion 102*a* bends in the direction approaching the third housing member 103, the volume of the first space 111 decreases. As a result, the fluid flows from the first space 111 to the third space 113 via the outlet 111*b* and is discharged from the discharge port 113*a* via the discharge port 113*a*, as indicated by an arrow. At this time, the suction port 112*a* is closed by the first check valve 105, and the fluid is prevented from flowing from the suction port 112*a*.

By repeating the bending of the movable portion 102*a* in this manner, the fluid is continuously sucked from the suction port 112*a* and discharged from the discharge port 113*a*. Thus, in the fluid control apparatus 100, a flow path is formed to be connected from the second space 112 to the first space 111 via the inlet 111*a* and from the first space 111 to the third space 113 via the outlet 111*b*, and the fluid is transported through the flow path.

[Position of Inlet and Outlet]

The suction port 112*a* and the discharge port 113*a* are positioned on an extension surface of the second housing member 102. As shown in FIG. 1, a surface on a first space 111 side among surfaces of the second housing member 102 is defined as a surface 102*c*. The surface 102*c* is an extension surface of the movable portion 102*a* which is a flat plate member. Furthermore, as shown in FIG. 1, a surface on the first space 111 side among surfaces of the third housing member 103 is defined as a surface 103*b*. The surface 103*b* is an extension surface of the facing portion 103*a* which is a flat plate member.

The suction port 112*a* and the discharge port 113*a* are provided on the surface 102*c*. As a result, flow path resistance of the fluid transported by the fluid control apparatus 100 can be reduced.

Figure 7:
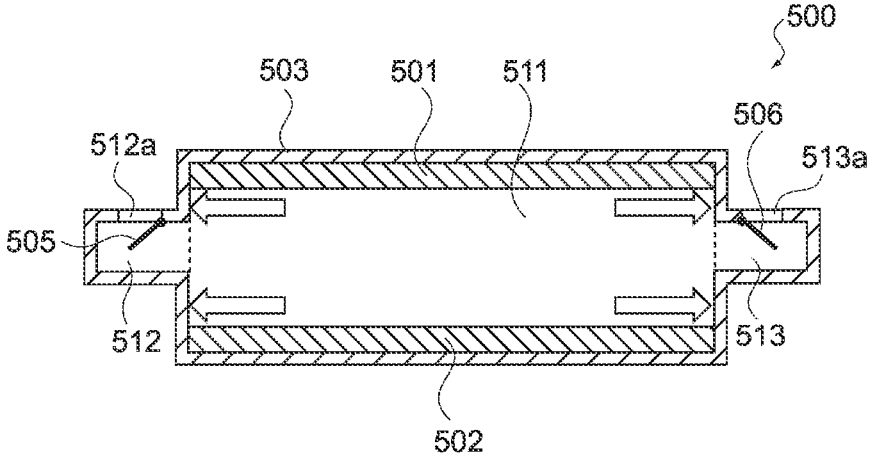
FIG. 7 is a cross-sectional diagram of a comparative fluid control apparatus.

FIG. 7 is a cross-sectional diagram of a comparative fluid control apparatus 500. As shown in FIG. 7, the fluid control apparatus 500 includes a first flat plate member 501, a second flat plate member 502, and a housing member 503, and one or both of the first flat plate member 501 and the second flat plate member 502 are elastic members that perform a bending operation.

A first space 511 having a variable volume is provided between the first flat plate member 501 and the second flat plate member 502, and a second space 512 and a third space 513 are provided adjoined to the first space 511. An suction port 512*a* in which a first check valve 505 is arranged is provided in the second space 512, and a discharge port 513*a* in which a second check valve 506 is arranged is provided in the third space 513.

In the fluid control apparatus 500, the suction port 512*a* and the discharge port 513*a* are not arranged on extension surfaces of the first flat plate member 501 and the second flat plate member 502. In this case, as shown by arrows in FIG. 7, steps are formed between the first space 511 and the second space 512 and between the first space 511 and the third space 513, and the flow path resistance is generated by the steps.

In contrast, in the fluid control apparatus 100 as shown in FIG. 1, between the first space 111 and the second space 112 and between the first space 111 and the third space 113 are connected on the same planes of the surface 102*c* of the second housing member 102 and the surface 103*b* of and the third housing member 103. Therefore, it is possible to reduce the flow path resistance in the fluid control apparatus 100. Note that only one of the suction port 112*a* and the discharge port 113*a* may be provided on the surface 102*c*, and one or both of the suction port 112*a* and the discharge port 113*a* may be provided on the surface 103*b*.

[Flow Path Shape]

As described above, in the fluid control apparatus 100, the flow path is formed to be connected from the second space 112 to the first space 111 via the inlet 111*a* and from the first space 111 to the third space 113 via the outlet 111*b*. The flow path suitably has a shape in which cross-sectional areas of the flow path continuously change from the suction port 112*a* to the discharge port 113*a*.

The shape in which the cross-sectional areas of the flow path continuously change is, for example, is such that, when a cross-sectional area of a pipeline changes from Sa to Sb, a distance from a position on the pipeline having the cross-sectional area Sa to a position on the pipeline having the cross-sectional area Sb is 0 or more, and the pipelines connecting form Sa to Sb are connected by a smooth line, but it is not limited thereto. Furthermore, the cross-sectional area of the flow path is a cross-sectional area having a shortest flow line at a normal connecting from the inlet to the outlet of flow lines in the pipeline.

Figure 8:
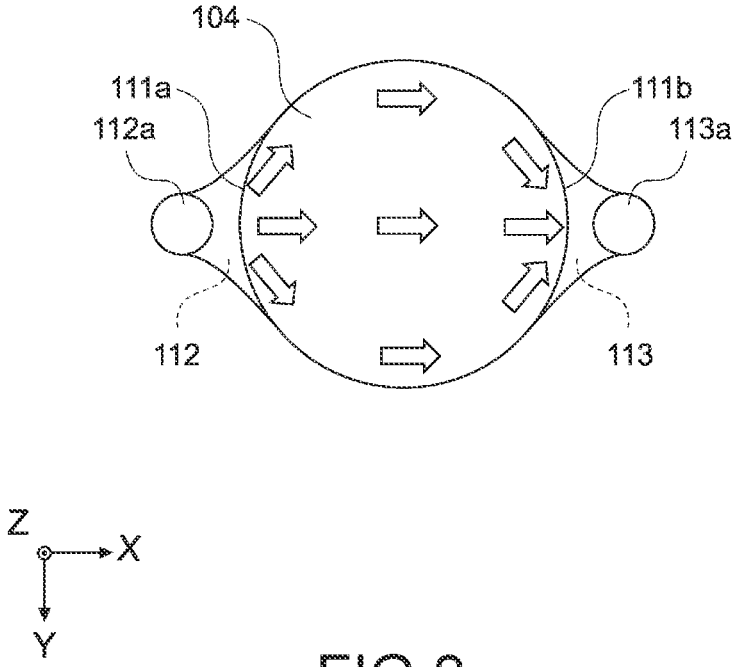
FIG. 8 is a schematic diagram showing a shape of the flow path and a fluid flow in the fluid control apparatus according to the embodiment of the present technology.

FIG. 8 is a schematic diagram showing the shape of the flow path and a fluid flow in the fluid control apparatus 100. As shown in FIG. 8, the first space 111 is circular viewed from the direction perpendicular to the second housing member 102 and the third housing member 103 (Z direction), and has a cylindrical shape taking the same direction (Z direction) as the height direction as shown in FIG. 3.

The second space 112 has a shape in which the cross-sectional area of the flow path gradually widens from the suction port 112*a*, and is connected to a side surface of the first space 111 via the inlet 111*a*. The third space 113 is connected to the side surface of the first space 111 via the outlet 111*b*, and has a shape in which the cross-sectional area of the flow path gradually decreases toward the discharge port 113*a*.

As shown by arrows in FIG. 8, the fluid can smoothly pass through the flow path in which the cross-sectional areas of the flow path formed by the second space 112, the first space 111, and the third space 113 continuously change, and thus the flow path resistance can be reduced.

Figure 9:
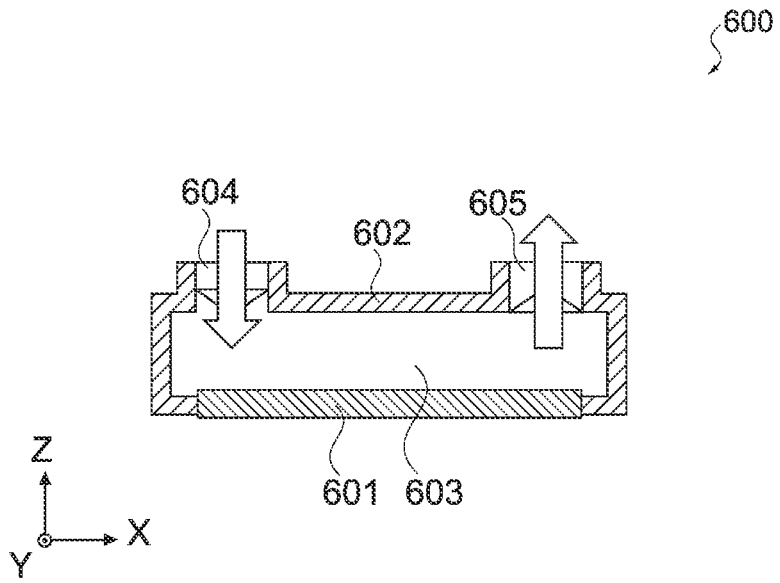
FIG. 9 is a cross-sectional diagram of a comparative fluid control apparatus.

FIG. 9 is a schematic diagram of a comparative fluid control apparatus 600. As shown in FIG. 9, the fluid control apparatus 600 includes a movable portion 601, a housing 602, a space 603, a suction port 604, and a discharge port 605. A check valve is provided at each of the suction port 604 and the discharge port 605. A space 603 has a volume varied by bending the movable portion 601, and the fluid flows in a direction perpendicular to the movable portion 601 and enters and exits the space 603. The cross-sectional area of the flow path rapidly increases from the suction port 604 to the space 603, and rapidly decreases from the space 603 to the discharge port 605.

Figure 10:
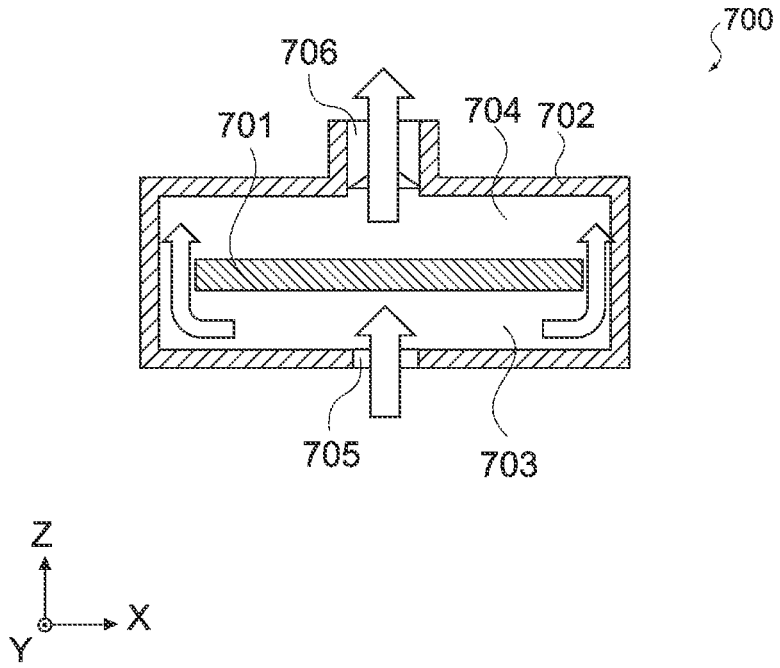
FIG. 10 is a cross-sectional diagram of a comparative fluid control apparatus.

FIG. 10 is a schematic diagram of a comparative fluid control apparatus 700. As shown in FIG. 10, the fluid control apparatus 700 includes a movable portion 701, a housing 702, a first space 703, a second space 704, a suction port 705, and a discharge port 706. A check valve is provided at the discharge port 706. The first space 703 and the second space 704 each has a volume varied by bending the movable portion 701, and the fluid flows in a direction perpendicular to the movable portion 701, enters the first space 703, flows in the same direction, and is discharged from the second space 704. Also in this case, the cross-sectional area of the flow path rapidly increases from the suction port 705 to the first space 703, and rapidly decreases from the second space 704 to the discharge port 706.

Figure 11:
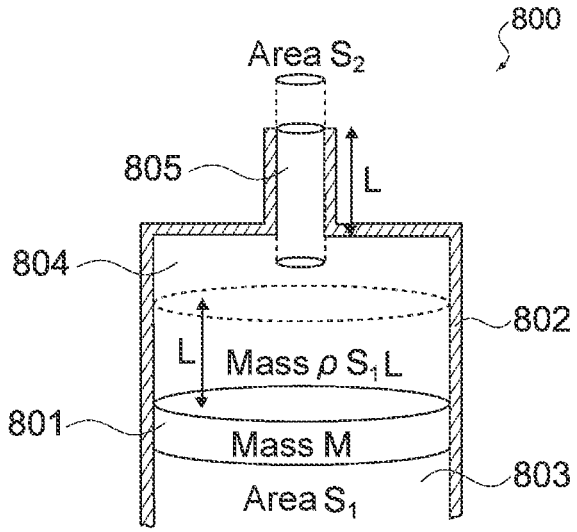
FIG. 11 is a cross-sectional diagram of a comparative fluid control apparatus.

FIG. 11 is a schematic diagram showing a partial configuration of a comparative fluid control apparatus 800. The fluid control apparatus 800 includes a piston 801, a housing 802, a first space 803, a second space 804, and an outlet 805. As shown in FIG. 11, when an area of the piston 801 is denoted as $S_1$, a mass of the piston 801 is denoted as M, a positional variation of the piston 801 is denoted as L, an area of the discharge port 805 is denoted as $S_2$, and a volume of the fluid moving by the positional variation of the piston 801 is denoted as $\rho S_1 L$, the following (Equation 1) is held.

[Math. 1]

$$(M+\rho S_1 L)\frac{d^2 \times (t)}{dt^2}+c\frac{dx(t)}{dt}+kx(t)= F\cos(\omega t)-\rho\frac{S_1^2}{S_2}\{a(t)|x(t)|+v(t)|v(t)|\} \quad \text{(Equation 1)}$$

As shown in (Equation 1), when a cross-sectional area ratio ($S_1/S_2$) of the piston 801 and the outlet 805 is large, large inertial resistance proportional to $v^2$ is generated. Therefore, since the cross-sectional area of the flow path in the fluid control apparatus 600 and the fluid control apparatus 700 changes rapidly, the flow path resistance is increased.

In contrast, since the cross-sectional areas of the flow path continuously change in the fluid control apparatus 100 according to the present embodiment, it is possible to reduce the flow path resistance.

[Arrangement of Suction Port and Discharge Port]

An arrangement of the suction port 112*a* and the discharge port 113*a* will be described. Each of FIGS. 12 to 15 is a schematic diagram showing the arrangement of the suction port 112*a* and the discharge port 113*a* and arrows in each figure indicate the fluid flow from the suction port 112*a* to the discharge port 113*a*.

Figure 12:
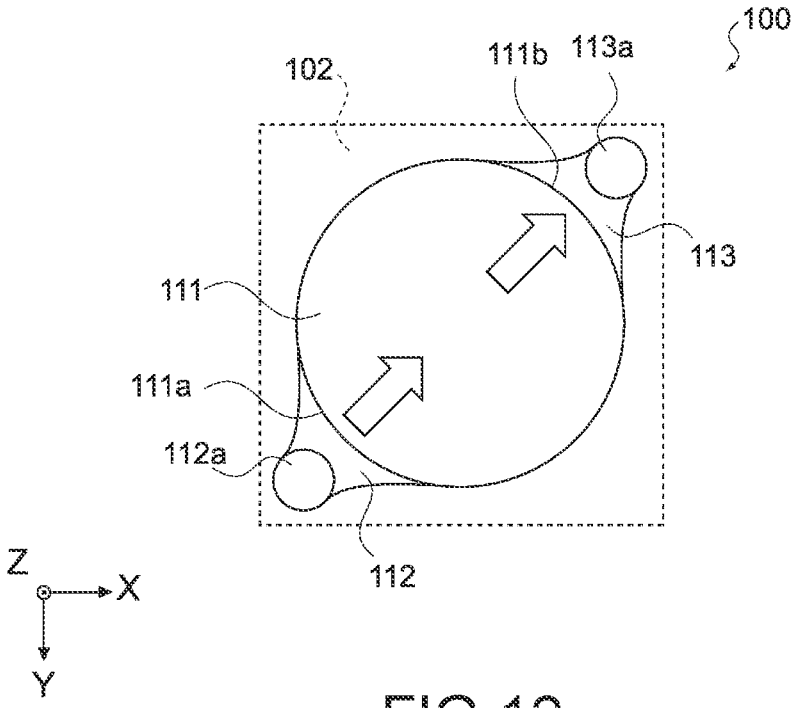
FIG. 12 is a schematic diagram showing an arrangement of a suction port and a discharge port in the fluid control apparatus according to the embodiment of the present technology.
Figure 13:
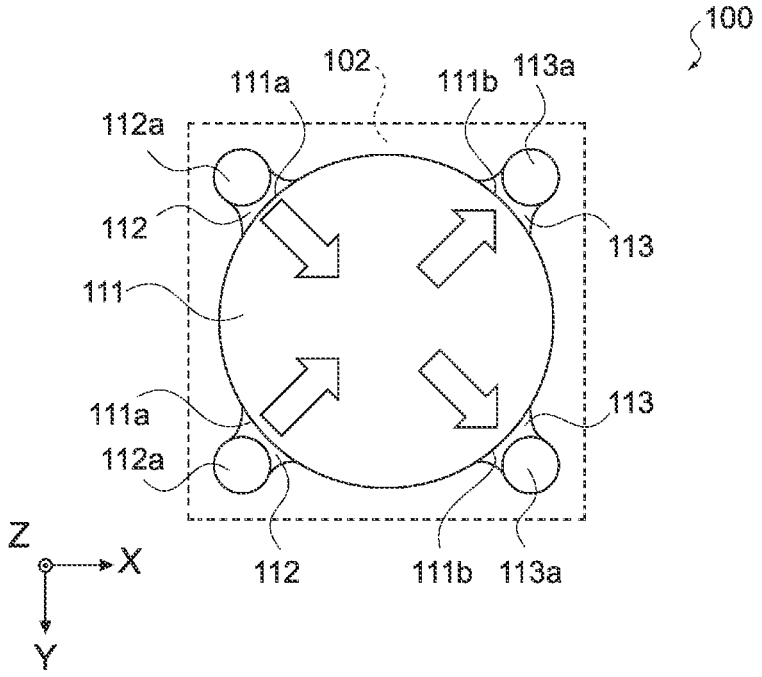
FIG. 13 is a schematic diagram showing an arrangement of a suction port and a discharge port in the fluid control apparatus according to the embodiment of the present technology.
Figure 14:
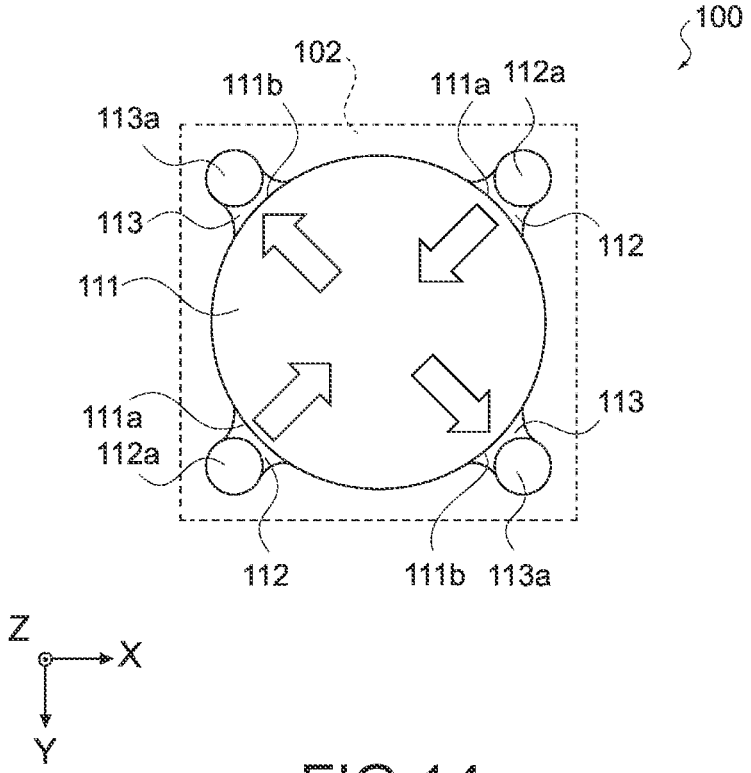
FIG. 14 is a schematic diagram showing an arrangement of a suction port and a discharge port in the fluid control apparatus according to the embodiment of the present technology.

As shown in FIG. 12, one suction port 112*a* and one discharge port 113*a* may be provided on opposite sides of the first space 111. As shown in FIG. 13 and FIG. 14, two suction ports 112*a* and two discharge ports 113*a* may be provided. As shown in FIG. 13, the suction ports 112*a* and the discharge ports 113*a* may be arranged on opposite sides of the first space 111, and as shown in FIG. 14, each suction port 112*a* and each discharge port 113*a* may be arranged on the opposite side of the first space 111.

Note that, as shown in FIG. 14, by facing the suction ports 112*a* each other and the discharge ports 113*a* each other, it is possible to suppress the generation of a vortex in the first space 111 and reduce a pressure loss.

Figure 15:
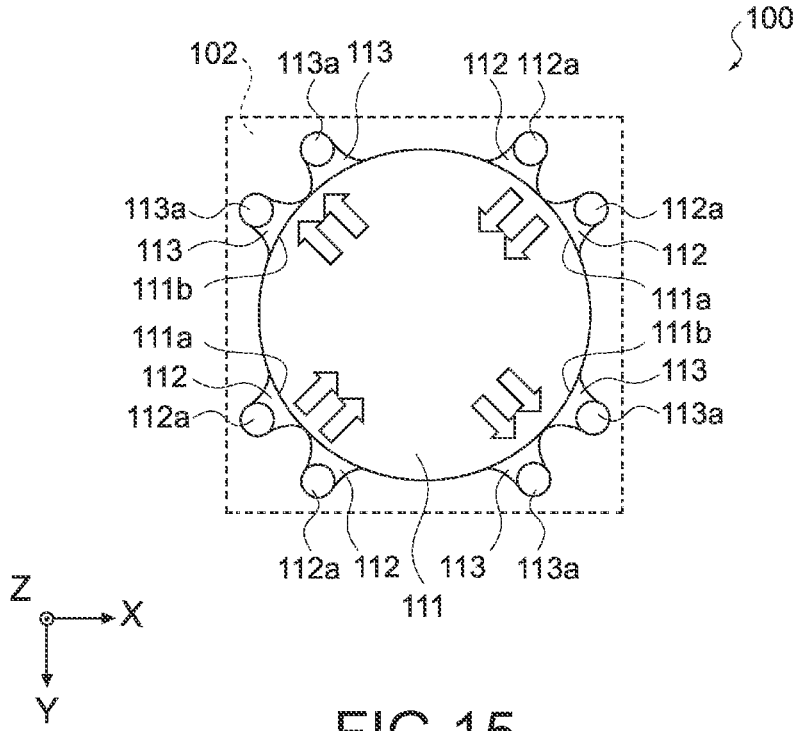
FIG. 15 is a schematic diagram showing an arrangement of a suction port and a discharge port in the fluid control apparatus according to the embodiment of the present technology.

Furthermore, as shown in FIG. 15, four suction ports 112*a* and four discharge ports 113*a* may be provided. In addition, an arbitrary number of suction ports 112*a* and discharge ports 113*a* can be provided.

Although the positions of the suction port(s) 112*a* and the discharge port(s) 113*a* are not particularly limited, as shown in FIGS. 12 to 15, when the housing of the fluid control apparatus 100 is the quadrangular shape viewed from the direction (Z direction) perpendicular to the second housing member 102 and the third housing member 103, and the first space 111 is circular viewed from the same direction, it is preferable to arrange the suction port(s) 112*a* and the discharge port(s) 113*a* at corners of the housing.

Figure 16:
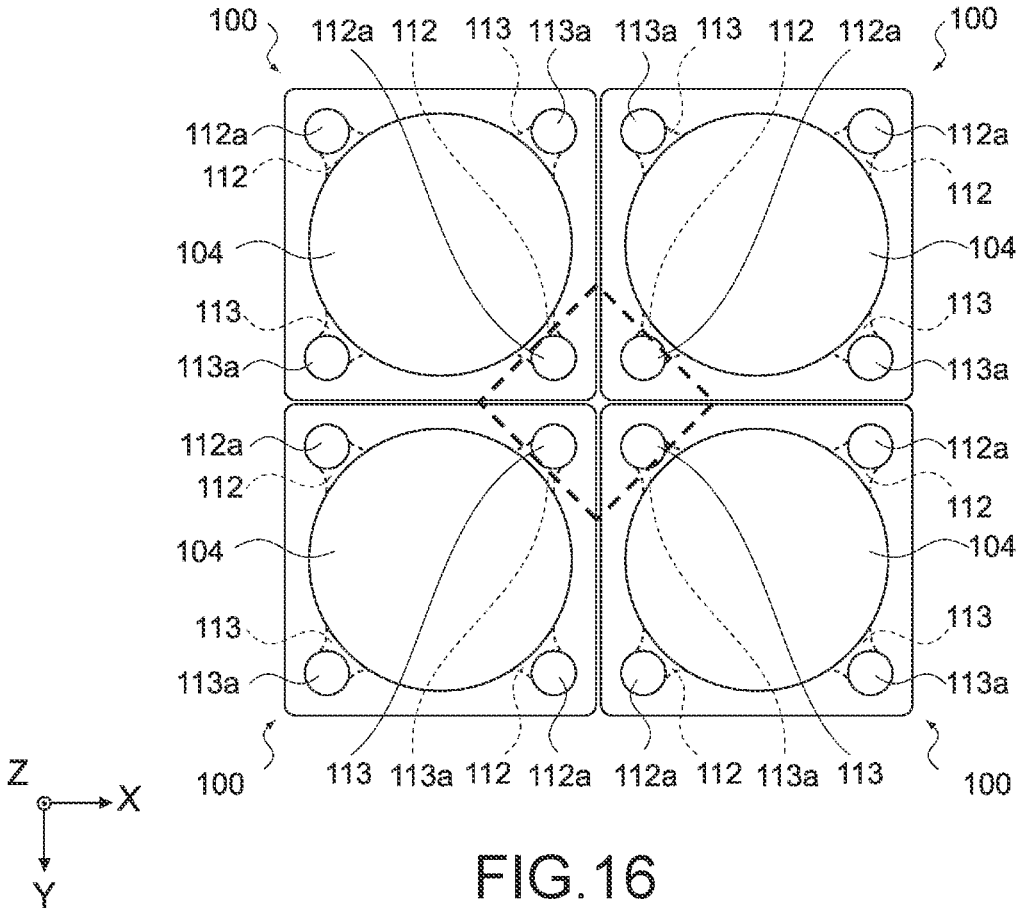
FIG. 16 is a plan diagram showing a tiled state of the fluid control apparatuses according to the embodiment of the present technology.

By arranging the suction port(s) 112*a* and the discharge port(s) 113*a* at the corners of the housing, a space inside the housing can be used without waste. In addition, efficiency is possible even if the fluid control apparatuses 100 are tiled. FIG. 16 is a schematic diagram showing a tiled state of the fluid control apparatuses 100.

As shown in FIG. 16, when tiling the fluid control apparatuses 100, since the first spaces 111 are circular whereas the housings are quadrangular shapes, spaces in corner portions of the housings (in FIG. 16, within broken line frame) are generated, and the suction ports 112*a* and the discharge ports 113*a* can be arranged in this space.

Figure 17:
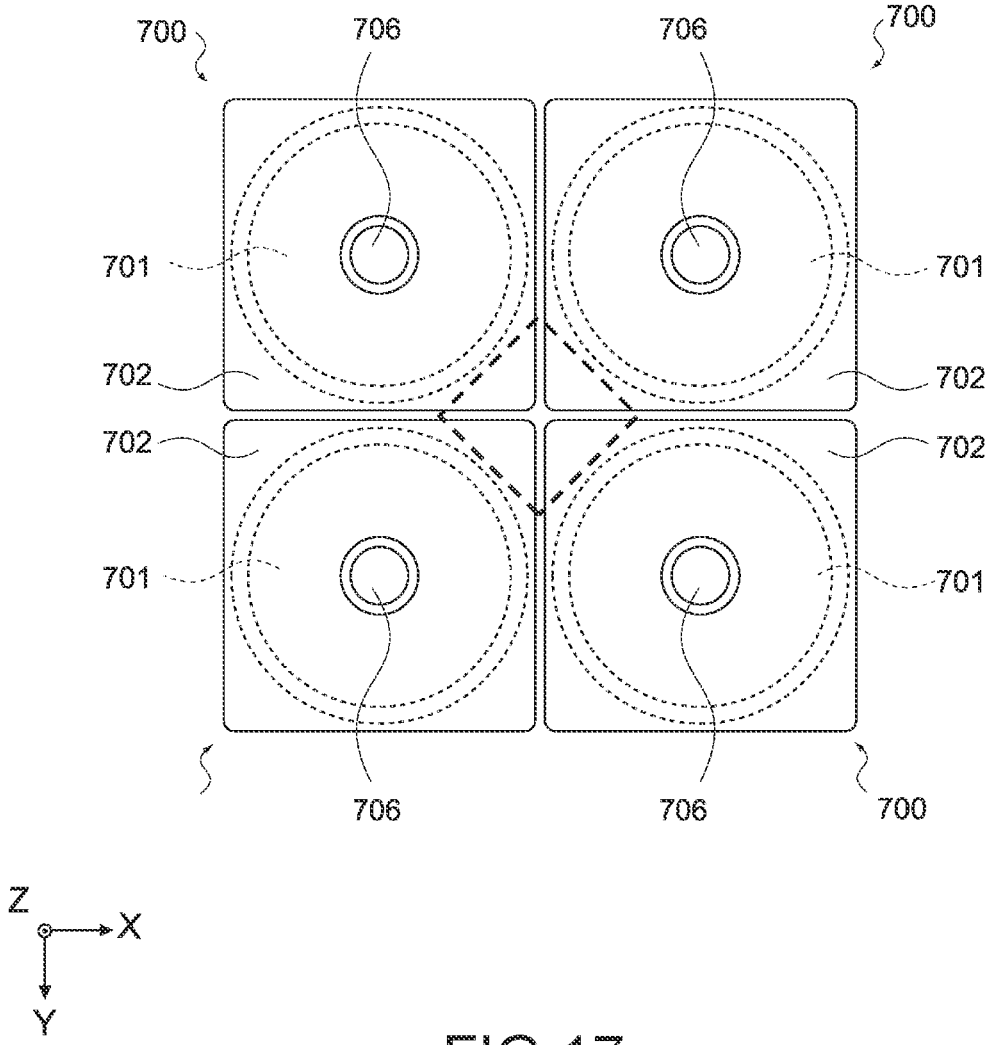
FIG. 17 is a plan diagram showing a tiled state of the comparative fluid control apparatuses.

FIG. 17 is a schematic diagram showing a tiled state of the comparative fluid control apparatuses 700. As shown in FIG. 17, when tiling the fluid control apparatuses 700, spaces (in FIG. 17, within broken line frame) are generated in corner portions of the housings, and the spaces will be dead spaces not utilized. Furthermore, since the suction ports 705 and the discharge ports 706 are positioned in the thickness direction of the housings, the thickness is increased as compared with the case of the fluid control apparatus 100.

In the fluid control apparatus 100, as shown in FIG. 16, by arranging the suction ports 112*a* and the discharge ports 113*a* in the spaces of the corner portions of the housings (in FIG. 16, within broken line frame), the spaces can be effectively used and the thickness can be suppressed. This allows the fluid control apparatus 100 to be tiled in a wide range of planes, e.g., haptic feedback, to form an array with high efficiency relative to an occupied area when utilized as a pump array.

Incidentally, in a case not only of each housing of each fluid control apparatus 100 in the quadrangular shape, but also of each housing in the hexagonal shape or the octagonal shape by arranging the suction ports 112*a* and the discharge ports 113*a* at the corners of the housings, the spaces among the first spaces 111 can be effectively utilized.

[Shapes of Second and Third Spaces]

As described above, the second space 112 is a space connecting the inlet port 112*a* and the inlet 111*a*, and forms the fluid flow path. The third space 113 is a space connecting the outlet 111*b* and the discharge port 113*a*, and forms the fluid flow path. Here, each of the second space 112 and the third space 113 may be a space in which the flow path using a curved surface is formed.

Figure 18:
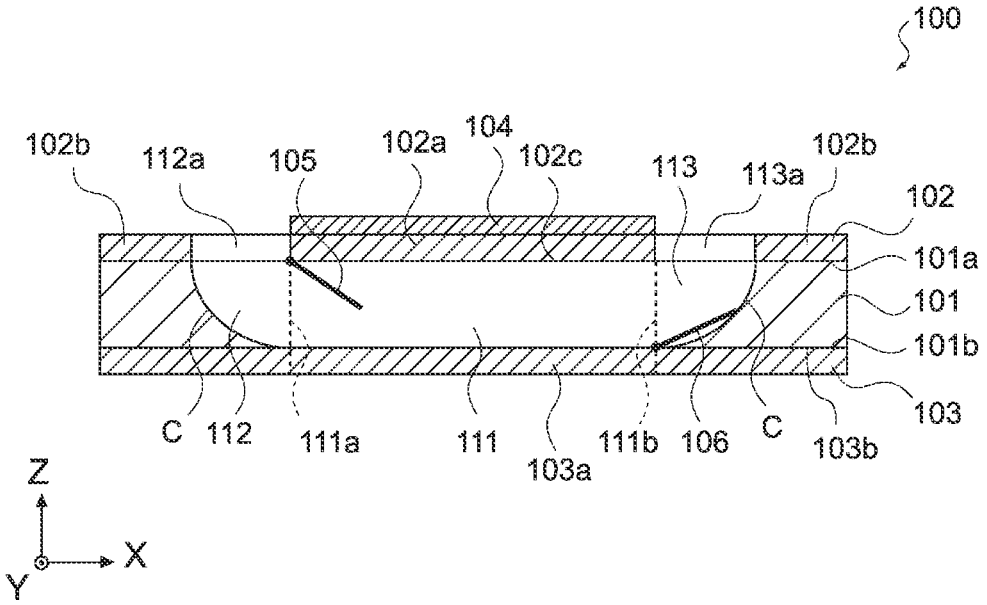
FIG. 18 is a cross-sectional diagram of shapes of a second space and a third space included in the fluid control apparatuses according to the embodiment of the present technology.
Figure 19:
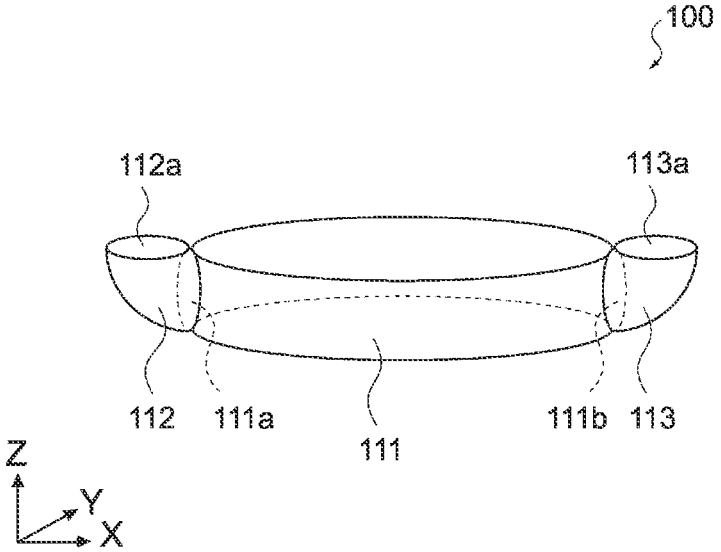
FIG. 19 is a schematic diagram showing the flow path included in the fluid control apparatuses according to the embodiment of the present technology.

FIG. 18 is a cross-sectional diagram of the fluid control apparatus 100 in which the second space 112 and the third space 113 form the flow path using the curved surfaces, and FIG. 19 is a schematic diagram showing the first space 111, the second space 112, and the third space 113 of the fluid control apparatus 100.

Figure 20:
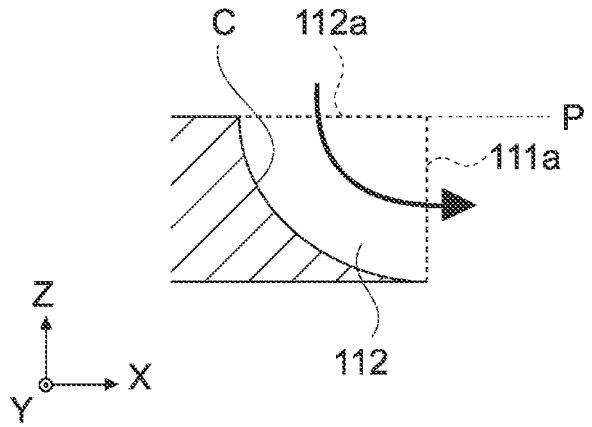
FIG. 20 is a cross-sectional diagram of the shape of the second space included in the fluid control apparatuses according to the embodiment of the present technology.

FIG. 20 is a cross-sectional diagram showing the second space 112 and the fluid flow by an arrow. P in FIG. 20 is an extension surface of the second housing member 102 (X-Y plane). The second space 112 has a curved surface C on an inner peripheral surface, and forms the flow path extending from the suction port 112*a* to the inlet 111*a* in the direction (Z direction) perpendicular to the extension surface P to the direction (X direction) parallel to the extension surface P.

Figure 21:
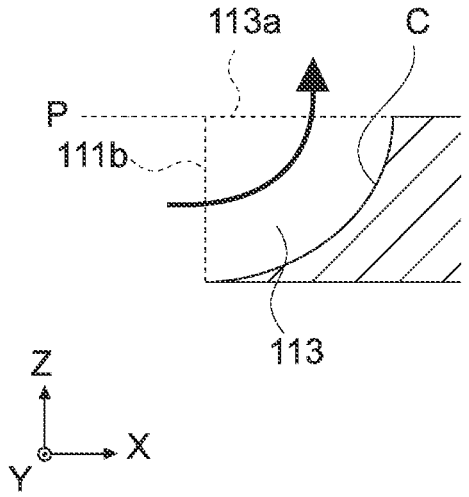
FIG. 21 is a cross-sectional diagram of the shape of the third space included in the fluid control apparatuses according to the embodiment of the present technology.

FIG. 21 is a cross-sectional diagram showing the third space 113 and the fluid flow by arrows. P in FIG. 21 is the extension surface of the second housing member 102 (X-Y plane). The third space 113 has the curved surface C on an inner peripheral surface, and forms the flow path extending from the outlet 111*b* to the discharge port 113*a* in the direction parallel to the extension plane P (X direction) to the direction perpendicular to the extension plane P (Z direction).

Such shapes of the second space 112 and the third space 113 enable a smooth connection between the suction port 112*a* and the first space 111, and between the first space 111 and the discharge port 113*a*, thereby reducing the flow path resistance.

[First Check Valve and Second Check Valve]

Figure 22:
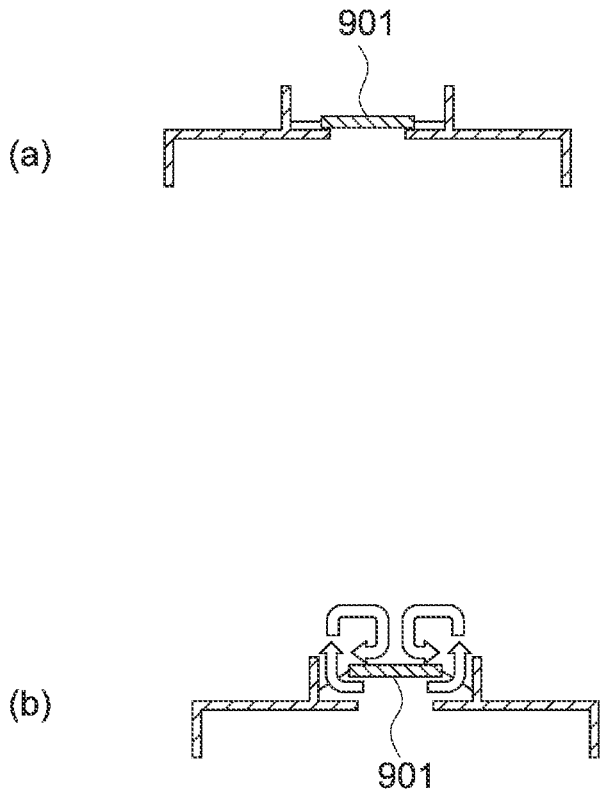
FIG. 22 is schematic diagrams showing a check valve of lift type.

The first check valve 105 and the second check valve 106 are preferably swing type check valves. FIG. 22 is a schematic diagram showing a check valve 901 of lift type, FIG. 22 (*a*) shows a state in which the check valve 901 is closed, FIG. 22 (*b*) shows a state in which the check valve 901 is open. As shown by arrows in FIG. 22 (*b*), in the state where the check valve 901 is open, a vortex due to winding of the fluid is generated, a pressure loss due to viscous resistance of the fluid is generated.

Figure 23:
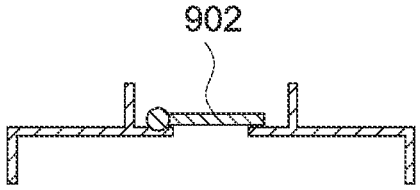
FIG. 23 is schematic diagrams showing a check valve of swing type.
Figure 23:
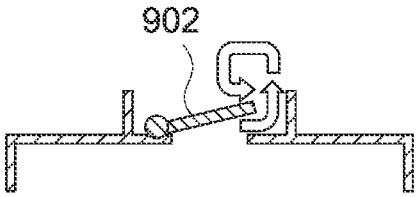

FIG. 23 is a schematic diagram showing a check valve 902 of swing type, FIG. 23 (*a*) shows a state in which the check valve 902 is closed, and FIG. 23 (*b*) shows a state in which the check valve 902 is open. As shown in FIG. 23, the swing type check valve is a check valve that is provided with a hinge at one point around the valve and swings around the hinge to open and close. As shown by arrows in FIG. 23 (*b*), also in the case of the swing type, in the state where the check valve 902 is open, the vortex due to winding of the fluid is generated, the pressure loss due to the viscous resistance of the fluid is generated.

Here, as shown in FIG. 18, the second check valve 106 has a structure in which the second check valve 106 is in close contact to the curved surface C of the third space 113 without a gap when the valve is opened. Thus, as shown in FIG. 23 (*b*), it is possible to prevent generation of a vortex and suppress the pressure loss. Incidentally, the second check valve 106 is suitably made of a flexible material such as polyethylene terephthalate, nylon, polyester and polypropylene so as to be in close contact with the curved surface C of the third space 113.

[Areas of Inlet and Outlet]

Figure 24:
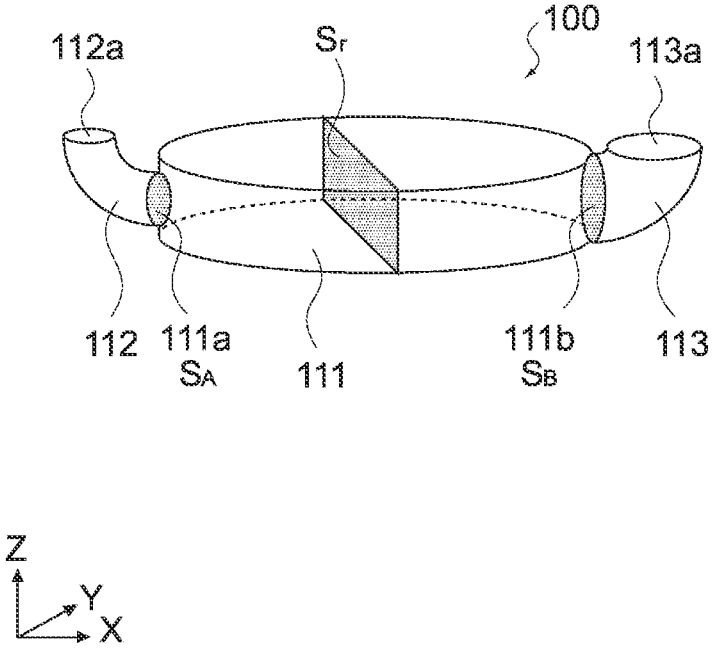
FIG. 24 is a schematic diagram showing a cross-sectional area of the flow path included in the fluid control apparatuses according to the embodiment of the present technology.

The areas of the inlet 111*a* and the outlet 111*b* may be the same, but may be different as described below. FIG. 24 is a schematic diagram showing the areas of the inlet 111*a* and the outlet 111*b*, and FIG. 25 is a schematic diagram showing the first space 111, the second space 112, and the third space 113.

Figure 25:
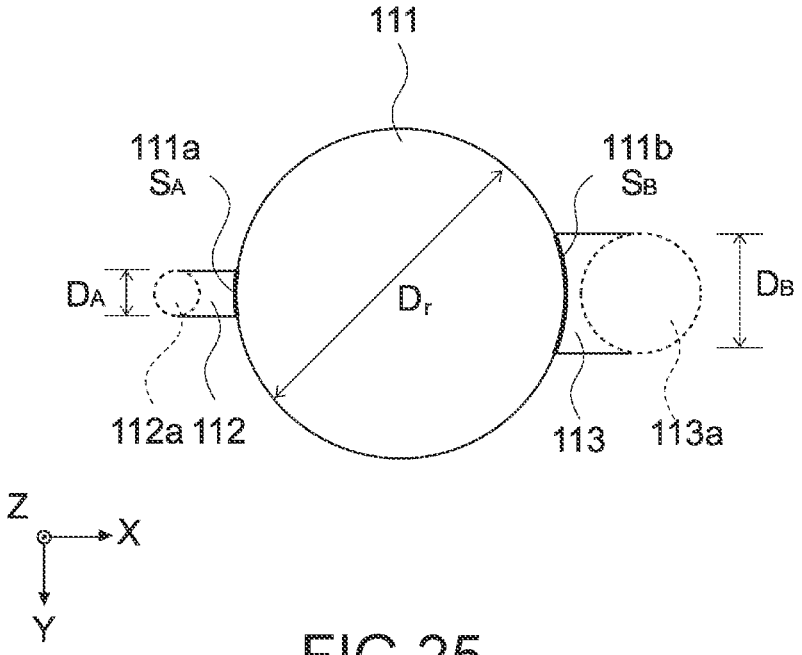
FIG. 25 is a schematic diagram showing a shape of the flow path included in the fluid control apparatuses according to the embodiment of the present technology.

As shown in FIGS. 24 and 25, the area of the inlet 111*a* is denoted as an area SA, the area of the outlet 111*b* is denoted as an area SB, and a representative cross-sectional area of the first space 111 is denoted as an area Sr. Furthermore, a diameter of the second space 112 is denoted as DA, a diameter of the third space 113 is denoted as DB, and a diameter of the first space 111 is denoted as Dr. Here, in the fluid control apparatus 100, the area SB can be larger than the area SA.

The flow path resistance of the fluid is caused by a change of the cross-sectional area perpendicular to a direction of a flow velocity (cross-sectional area of flow path). Due to a difference between the cross-sectional area of the flow path on an upstream side and the cross-sectional area of the flow path on a downstream side with respect to the flow velocity, the general flow path resistance is as follows: In the following description, the fluid flowing through the fluid control apparatus 100 is assumed as air.

Figure 26:
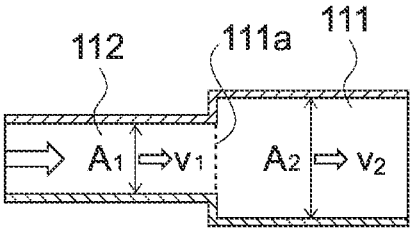
FIG. 26 is a schematic diagram showing a cross-sectional area of the flow path of a first space and a second space included in the fluid control apparatuses according to the embodiment of the present technology.

FIG. 26 is a schematic diagram showing the cross-sectional area of the flow path on an inlet 111*a* side. As shown in FIG. 26, when the cross-sectional area of the flow path of the second space 112 is denoted as $A_1$, the flow rate of the fluid flowing through the second space 112 is denoted as $v_1$, the cross-sectional area of the flow path of the first space 111 is denoted as $A_2$, and the flow rate of the fluid flowing through the first space 111 is denoted as an $v_2$, the flow resistance $\Delta P_{SD}$ is expressed by the following (Equation 2).

[Math. 2]

$$\Delta P_{sd} = \xi_d \frac{\rho v_1^2}{2} \qquad \text{(Equation 2)}$$

$$\xi_d = \xi\left(1 - \frac{A_1}{A_2}\right)^2$$

$\xi$ is a coefficient that changes depending on an area ratio $A_1/A_2$, and is approximately 1.

Figure 27:
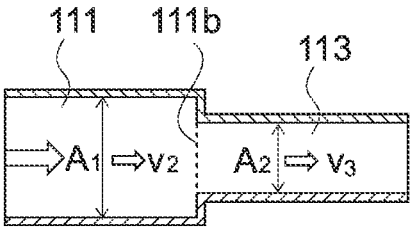
FIG. 27 is a schematic diagram showing a cross-sectional area of the flow path of the second space and a third space included in the fluid control apparatuses according to the embodiment of the present technology.

FIG. 27 is a schematic diagram showing the cross-sectional area of the flow path on an outlet 111*b* side. As shown in FIG. 27, when the cross-sectional area of the flow path of the first space 111 is denoted as $A_1$, the flow rate of the fluid flowing through the first space 111 is denoted as $v_2$, the cross-sectional area of the flow path of the third space 113 is denoted as $A_2$, and the flow rate of the fluid flowing through the third space 113 is denoted as $v_3$, the flow resistance $\Delta P_{SC}$ is expressed by the following (Equation 3).

[Math. 3]

$$\Delta P_{sc} = \xi_c \frac{\rho v_2^2}{2} \qquad \text{(Equation 3)}$$

$$\xi_c = \left(\frac{1}{C_c} - 1\right)$$

$C_C$ and $\xi_C$ are as shown in [Table 1] below, depending on $A_2/A_1$.

TABLE 1

| $A_2/A_1$ | 0.1 | 0.2 | 0.3 | 0.4 | 0.5 | 0.6 | 0.7 | 0.8 | 0.9 | 1.0 |
|---|---|---|---|---|---|---|---|---|---|---|
| $C_C$ | 0.61 | 0.62 | 0.63 | 0.65 | 0.67 | 0.70 | 0.73 | 0.77 | 0.84 | 1.00 |
| $\zeta_C$ | 0.41 | 0.38 | 0.34 | 0.29 | 0.24 | 0.18 | 0.14 | 0.089 | 0.036 | 0 |

Therefore, in the flow path from the inlet 111*a* to the outlet 111*b*, a resistance coefficient of the outlet 111*b* becomes smaller than that of the inlet 111*a* when the area $S_B$ is made larger than the area $S_A$, that is, $S_A<S_B$. Accordingly, the flow path resistance is reduced, and it is possible to create a smooth flow of fluid.

For example, the resistance coefficient $\zeta_d$ of the inlet 111*a* and the resistance coefficient $\zeta_c$ of the outlet 111*b* are calculated. When the area $S_A$ is 0.1 $mm^2$, the representative cross-sectional area $S_r$ is 0.9 $mm^2$, and the area $S_B$ is 0.3 $mm^2$, the resistance coefficient is 0.889, and the resistance coefficient $\zeta_c$ is 0.34. In the case of $S_A<S_B$, the resistance coefficient of the outlet 111*b* becomes smaller than the resistance coefficient $\zeta_d$ of the inlet 111*a*.

Figure 28:
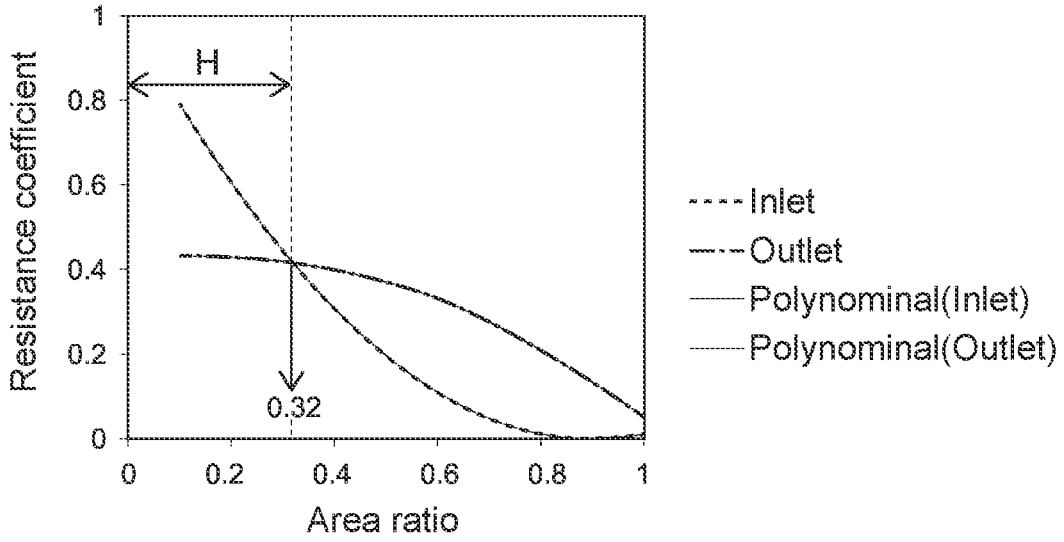
FIG. 28 is a graph showing a relationship between an area ratio of the inlet and the outlet and a resistance coefficient.

FIG. 28 is a graph showing a relationship between the area ratio ($S_A/S_B$) of the inlet 111*a* and the outlet 111*b* and the resistance coefficient. When the area ratio ($S_A/S_B$) is less than 0.3, the resistance coefficient of the outlet 111*b* becomes smaller than the resistance coefficient of the inlet 111*a*, as indicated by the range H in FIG. 28. On the other hand, when the area ratio ($S_A/S_B$) is 0.3 or more, the resistance coefficient of the outlet 111*b* becomes larger than the resistance coefficient of the inlet 111*a*. Therefore, the area ratio ($S_A/S_B$) is preferably those satisfying $S_A/S_B<0.3$.

From the above, it is preferable that the inlet 111*a* and the outlet 111*b* have the relationship $S_A<S_B$ and $S_A/S_B<0.3$. In the above description, the case where the fluid flowing through the fluid control apparatus 100 is air has been described, but even when the fluid is other than air, the inlet 111*a* and the outlet 111*b* become $S_A<S_B$, whereby the resistance coefficient of the outlet 111*b* can be made smaller than that of the inlet 111*a*, that is, the flow path resistance can be made smaller.

The sizes of the first space 111, the second space 112, and the third space 113 are not particularly limited, but, for example, the diameter DA may be 1 mm, the diameter DB may be 2 mm, and the diameter $D_r$ may be 9 mm.

[Other Configurations of Second Space and Third Space]

Figure 29:
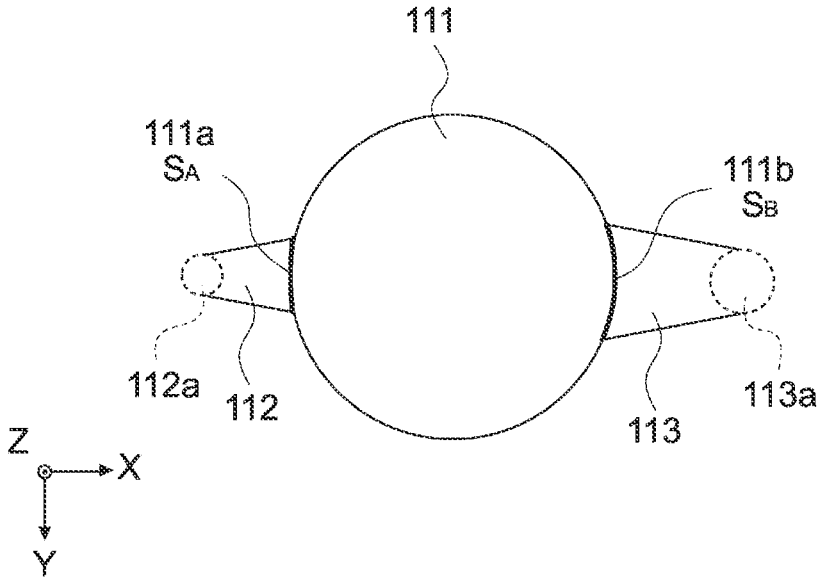
FIG. 29 is a schematic diagram showing the shape of the flow path and a fluid flow included in the fluid control apparatus according to the embodiment of the present technology.
Figure 30:
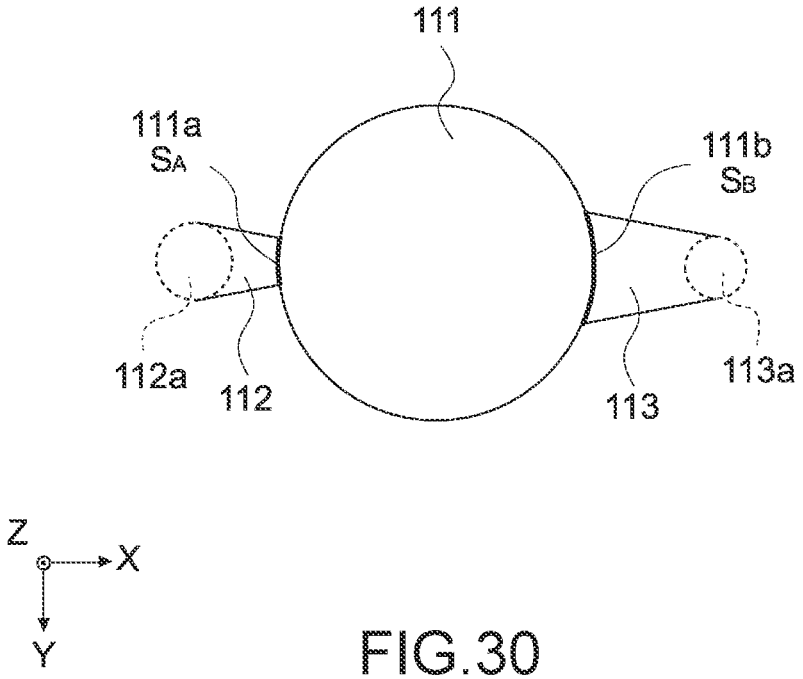
FIG. 30 is a schematic diagram showing the shape of the flow path and a fluid flow included in the fluid control apparatus according to the embodiment of the present technology.

The second space 112 and the third space 113 may have the cross-sectional areas of the flow path that continuously change. FIGS. 29 and 30 are schematic diagrams of the fluid control apparatus 100 including the second space 112 and the third space 113 having the cross-sectional areas of the flow path that continuously change.

As shown in FIG. 29, the second space 112 may have a shape in which the cross-sectional areas of the flow path continuously increase from the suction port 112*a* to the inlet 111*a*, and the third space 113 may have a shape in which the cross-sectional areas of the flow path continuously decrease from the outlet 111*b* to the discharge port 113*a*. The area $S_A$ of the inlet 111*a* and the area $S_B$ of the outlet 111*b* are formed to be $S_A<S_B$. With this configuration, it is possible to increase the flow rate of the fluid transported by the fluid control apparatus 100.

Furthermore, as shown in FIG. 30, the second space 112 may have a shape in which the cross-sectional areas of the flow path continuously decrease from the suction port 112*a* to the inlet 111*a*, and the third space 113 may have a shape in which the cross-sectional areas of the flow path continuously decrease from the outlet 111*b* to the discharge port 113*a*. The area $S_A$ of the inlet 111*a* and the area $S_B$ of the outlet 111*b* are formed to be $S_A<S_B$. With this configuration, it is possible to increase a delivery pressure by the fluid control apparatus 100.

Figure 31:
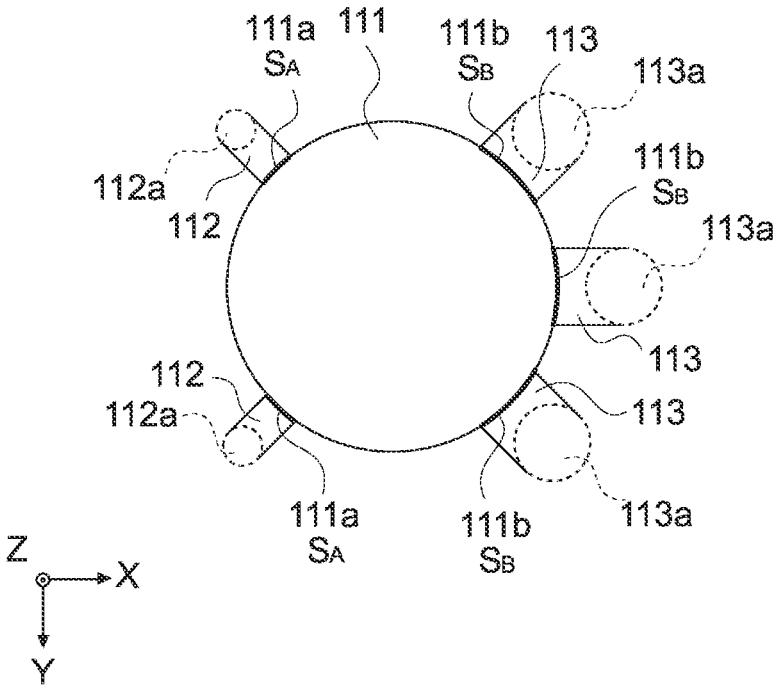
FIG. 31 is a schematic diagram showing the shape of the flow path and a fluid flow included in the fluid control apparatus according to the embodiment of the present technology.
Figure 32:
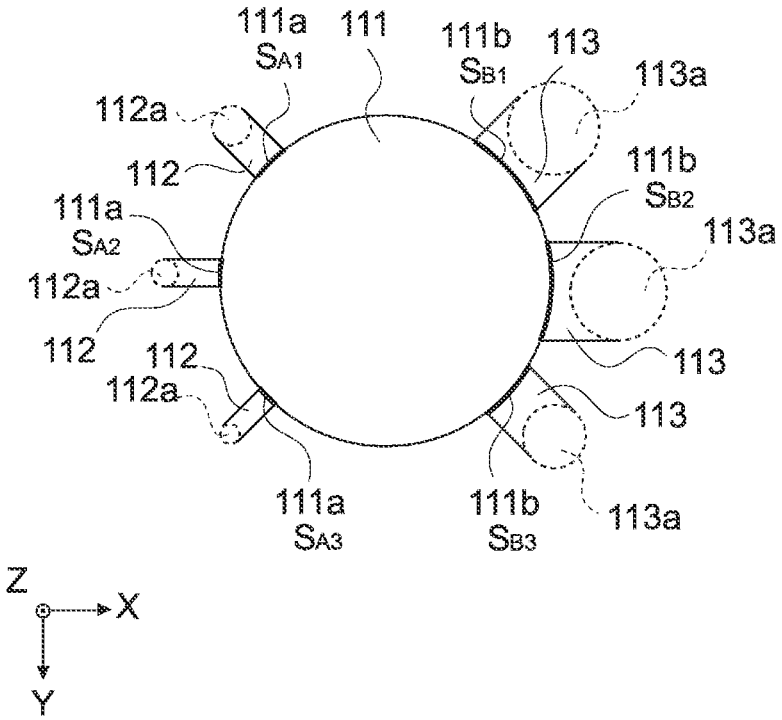
FIG. 32 is a schematic diagram showing the shape of the flow path and a fluid flow included in the fluid control apparatus according to the embodiment of the present technology.

As shown in FIGS. 31 and 32, a plurality of the second spaces 112 and a plurality of the third spaces 113 may be provided. As shown in FIG. 31, the fluid control apparatus 100 may include two inlets 111*a* each having an area $S_A$ and three outlets 111*b* each having an area $S_B$.

The fluid control apparatus 100 having a total area ($2S_A$) of the inlet 111*a* smaller than a total area ($3S_B$) of the outlet 111*b* is preferable because the flow path resistance is small. The number of the second spaces 112 and the number of the third spaces 113 are not limited to those described above, and may be one or more. Each of the second space 112 and the third space 113 may have the cross-sectional areas of the flow path that continuously change as shown in FIGS. 29 and 30.

Furthermore, as shown in FIG. 32, a plurality of the second spaces 112 and a plurality of the third spaces 113 are provided, and each area $S_A$ is different from each other, each area $S_B$ may be different from each other. When the areas of the inlet 111*a* are denoted as $S_{A1}$, $S_{A2}$ and $S_{A3}$, respectively, and the areas of the outlet 111*b* are denoted as $S_{B1}$, $S_{B2}$ and $S_{B3}$, respectively, it is preferable that the largest one of $S_{A1}$, $S_{A2}$ and $S_{A3}$ is smaller than the smallest one of $S_{B1}$, $S_{B2}$ and $S_{B3}$, and the sum ($S_{A1}+S_{A2}+S_{A3}$) of the areas of the inlet 111*a* is smaller than the sum ($S_{B1}+S_{B2}+S_{B3}$) of the areas of the outlet 111*b*, because the flow path resistivity is small.

The number of the second spaces 112 and the third spaces 113 is not limited, and may be one or more. The second space 112 and the third space 113 may have the cross-sectional areas of the flow path that continuously change as shown in FIGS. 29 and 30.

[Other Configuration of First Space]

Figure 33:
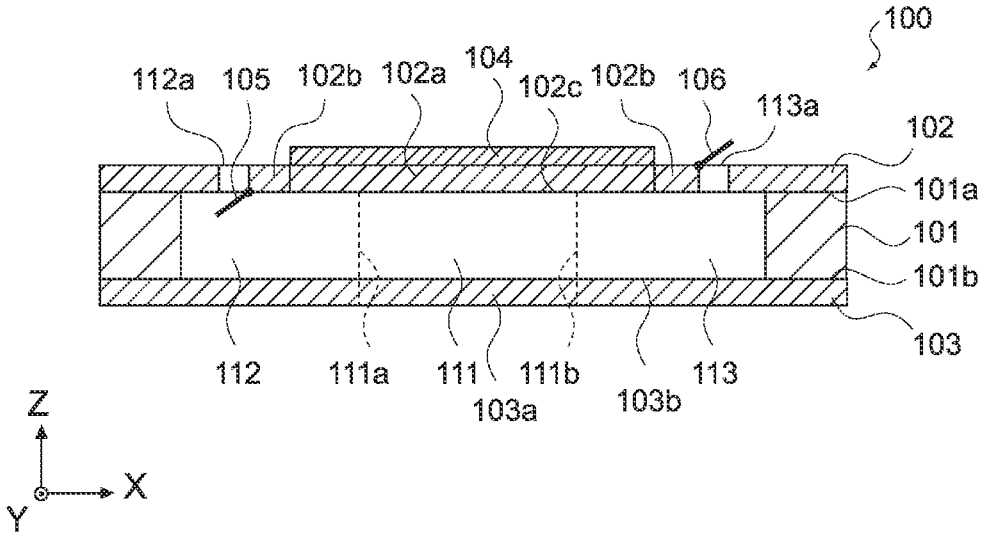
FIG. 33 is a cross-sectional diagram showing the first space smaller than the movable portion included in the fluid control apparatuses according to the embodiment of the present technology.

The first space 111 may have the following configuration. FIG. 33 is a cross-sectional diagram of the fluid control apparatus 100 having a structure in which the first space 111 is smaller than the movable portion 102*a*, and FIG. 34 is a schematic diagram of the fluid control apparatus 100.

Figure 34:
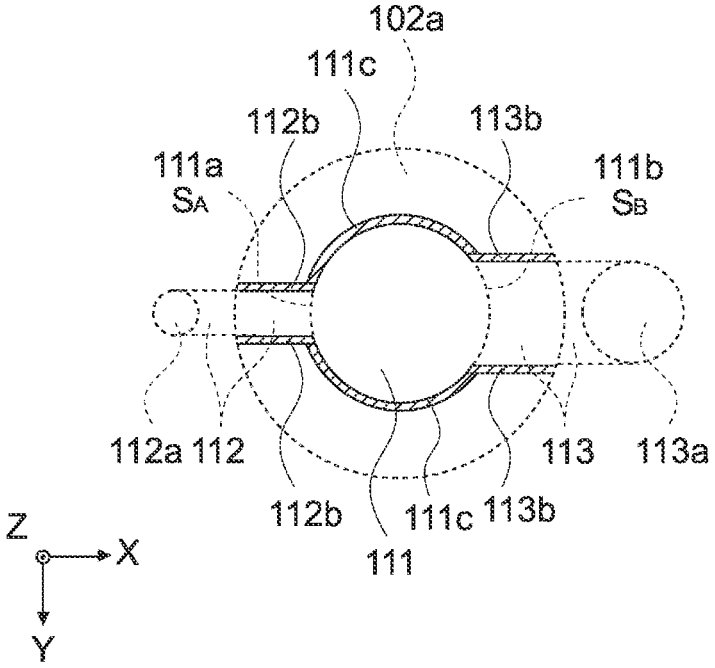
FIG. 34 is a schematic diagram showing walls for forming the flow path included in the fluid control apparatuses according to the embodiment of the present technology.

As shown in FIG. 34, a wall 111*c* is provided between the movable portion 102*a* and the facing portion 103*a*, and a first space 111 smaller than the space between the movable portion 102*a* and the facing portion 103*a* is formed by the wall 111*c*. In addition, a wall 112*b* and a wall 113*b* connected to the wall 111*c* are provided between the movable portion 102*a* and the third housing member 103, and the second space 112 and the third space 113 communicating with the first space 111 are formed.

Figure 35:
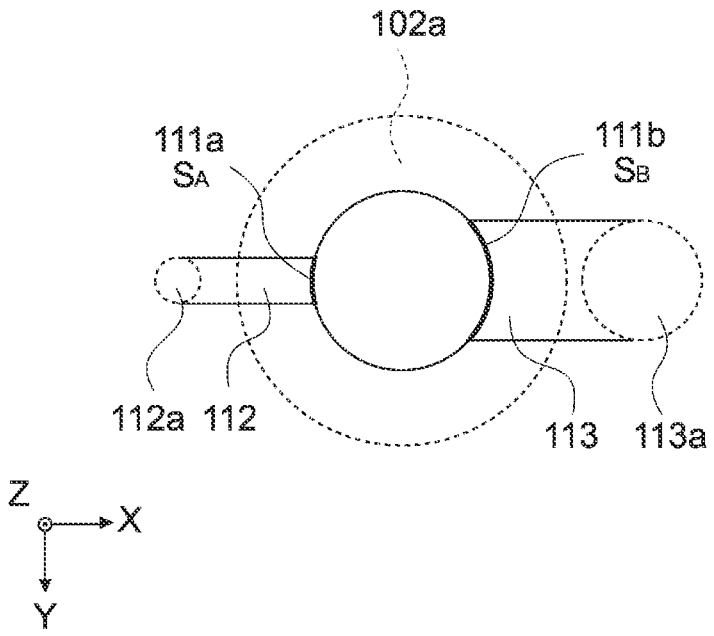
FIG. 35 is a schematic diagram showing the shape of the flow path included in the fluid control apparatus according to the embodiment of the present technology.

FIG. 35 is a schematic diagram showing the first space 111, the second space 112, and the third space 113 of the fluid control apparatus 100. As shown in FIG. 35, a part of the second space 112 and a part of the third space 113 are provided between the movable portion 102*a* and the third housing member 103. The area $S_A$ of the inlet 111*a* and the area $S_B$ of the outlet 111*b* are formed to be $S_A<S_B$.

From the state equation of the gas (PV=nRT), when the volume of the first space 111 is V and a volume change amount when the movable portion 102*a* bends is ΔV, the pressure P' is expressed by the following (Equation 4).

[Math. 4]

$$P' = \frac{V}{V+\Delta V}P \qquad \text{(Equation 4)}$$

Therefore, when ΔV is constant and the volume V is reduced, it is possible to increase the degree of influence of ΔV, and to increase the delivery pressure of the fluid control apparatus 100. In the space between the movable portion 102*a* and the facing portion 103*a*, the space outside the wall 111*c*, that is, the space other than the first space 111, is not used for transporting the fluid, and therefore, a filler or the like may be filled and sealed.

Figure 36:
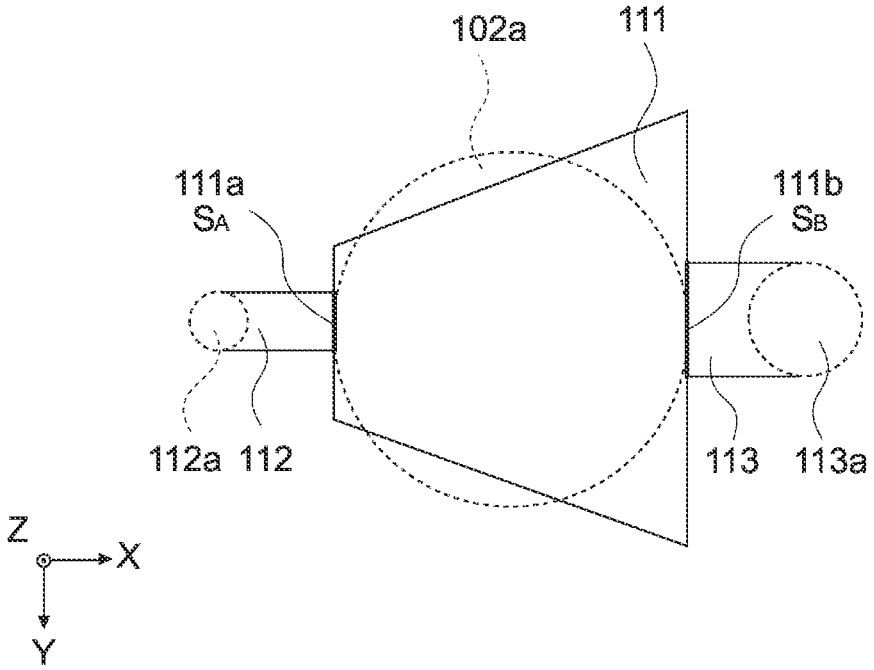
FIG. 36 is a schematic diagram showing the shape of the flow path included in the fluid control apparatus according to the embodiment of the present technology.

FIG. 36 is a schematic diagram of the fluid control apparatus 100 in which the first space 111 has a shape different from that of the movable portion 102*a*. As shown in FIG. 36, the first space 111 has a trapezoidal shape having a short side on a second space 112 side and a long side on a third space 113 side as viewed from a direction (Z direction) perpendicular to the movable portion 102*a*, and is formed such that the cross-sectional areas of the flow path continuously increase from the inlet 111*a* to the outlet 111*b*. The area $S_A$ of the inlet 111*a* and the area $S_B$ of the outlet 111*b* are formed to be $S_A<S_B$.

By forming the first space 111 in this shape, it is possible to reduce the flow path resistance of the fluid flowing in the first space 111. The shape of the first space 111 is not limited to the trapezoidal shape, and it is also possible to adopt another shape in which the cross-sectional areas of the flow path continuously increase from the inlet 111*a* to the outlet 111*b*.

Figure 37:
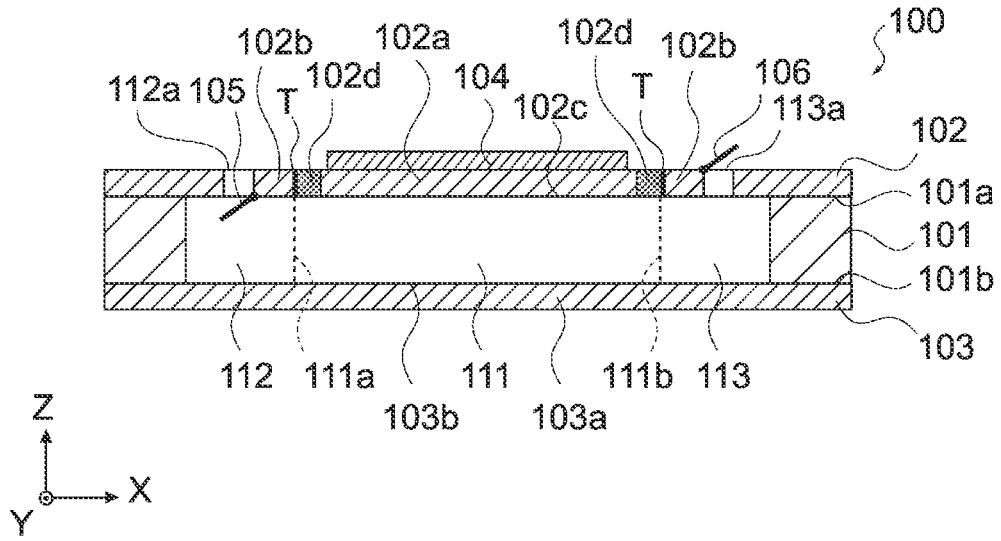
FIG. 37 is a cross-sectional diagram showing a spring portion included in the fluid control apparatus according to the embodiment of the present technology.

[Configuration of second housing member] The second housing member 102 may have the following configuration. FIG. 37 is a cross-sectional diagram of the fluid control apparatus 100, FIG. 38 is a plan diagram of the second housing member 102.

Figure 38:
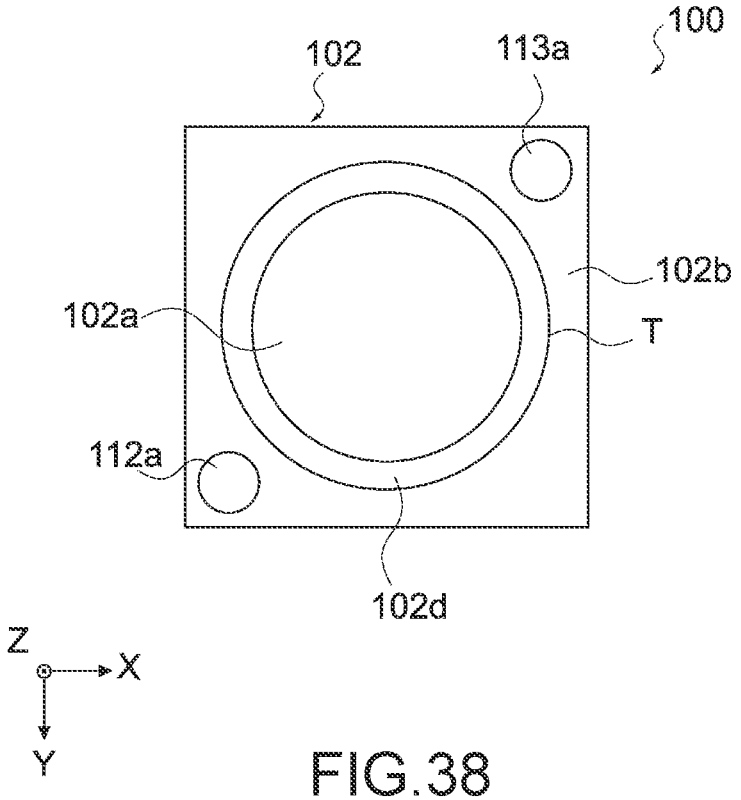
FIG. 38 is a cross-sectional diagram showing a spring portion included in the fluid control apparatus according to the embodiment of the present technology.

As shown in FIGS. 37 and 38, a spring portion 102*d* is provided between the movable portion 102*a* and the fixed portion 102*b*, and the movable portion 102*a* and the spring portion 102*d* constitute the elastic body. An end surface T positioned on an outer periphery of the spring portion 102*d* is fixed to the fixed portion 102*b*, and the spring portion 102*d* connects the movable portion 102*a* and the fixed portion 102*b*.

The spring portion 102*d* is formed so as to have lower rigidity than the fixed portion 102*b*, and promotes bending of the movable portion 102*a* by causing elastic deformation. The rigidity of the spring portion 102*d* is different from the rigidity of the movable portion 102*a*, and may be larger or smaller than the rigidity of the movable portion 102*a*. The spring portion 102*d* may be made of the same material as the movable portion 102*a* and the fixed portion 102*b*, or may be made of different materials. The spring portion 102*d* is formed in the entire region between the movable portion 102*a* and the fixed portion 102*b*, and there is no gap between the movable portion 102*a* and the fixed portion 102*b*, or the gap may be minimal.

Figure 39:
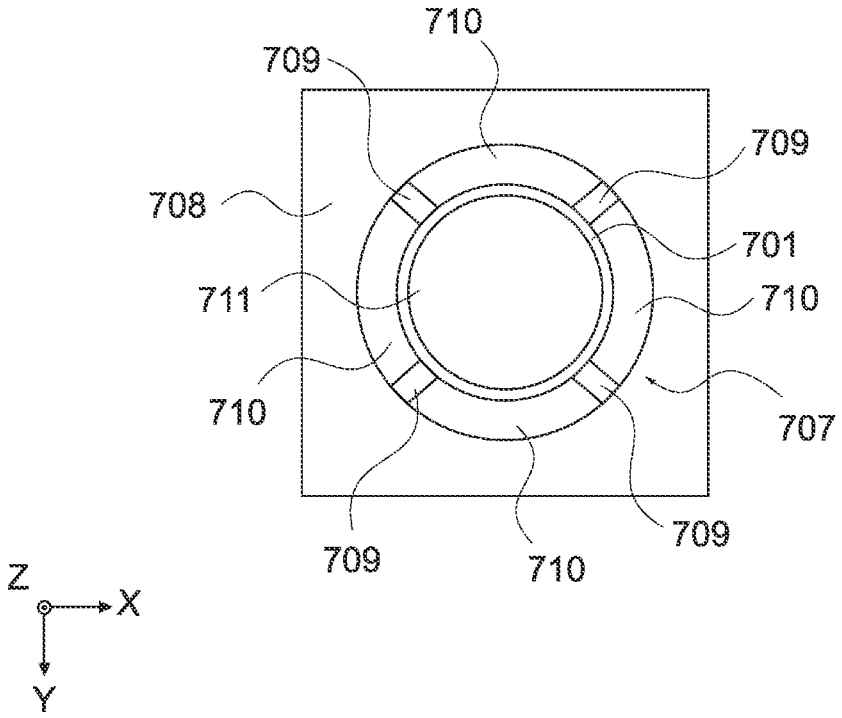
FIG. 39 is a plan diagram showing a movable portion and a spring portion included in the comparative fluid control apparatus.

FIG. 39 is a plan diagram of a diaphragm structure including the movable portion 701 of the comparative fluid control apparatus 700 (see FIG. 10). As shown in FIG. 39, a spring portion 707 is provided between the movable portion 701 and the fixing portion 708. The spring portion 707 has springs 709 which are intermittently arranged around the movable portion 701, and a gap 710 is provided between the springs 709. A piezoelectric element 711 is arranged on the movable portion 701.

Figure 40:
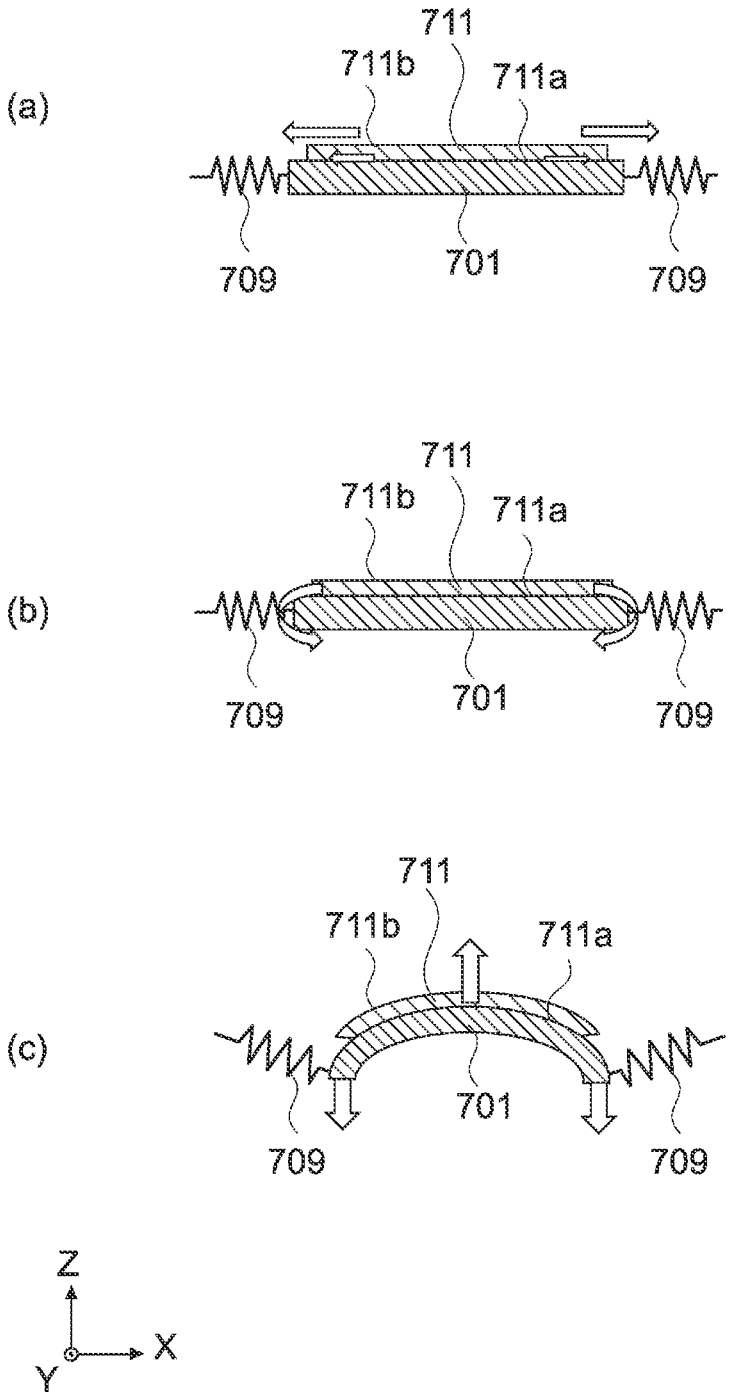
FIG. 40 is schematic diagrams showing an operation of the movable portion and the spring portion included in the comparative fluid control apparatus.

FIG. 40 is a schematic diagram showing a bending operation of the movable portion 701. As shown in FIG. 40 (*a*), when a voltage is applied to the piezoelectric element 711, a stress difference (arrows in FIG. 40 (*a*)) occurs between an elastic body side surface 711*a* and an opposite side surface 711*b* of the piezoelectric element 711.

As shown in FIG. 40 (*b*), by the stress difference, moments (arrows in FIG. 40 (*b*)) are generated at a boundary between the movable portion 701 and the springs 709 as fulcrums. Thus, as shown in FIG. 40 (*c*), deflections in the opposite direction at a center portion and an end portion of the movable portion 701 (arrows in FIG. 40 (*c*)) are generated, and the movable portion 701 is bent while stretching the spring 709.

Figure 41:
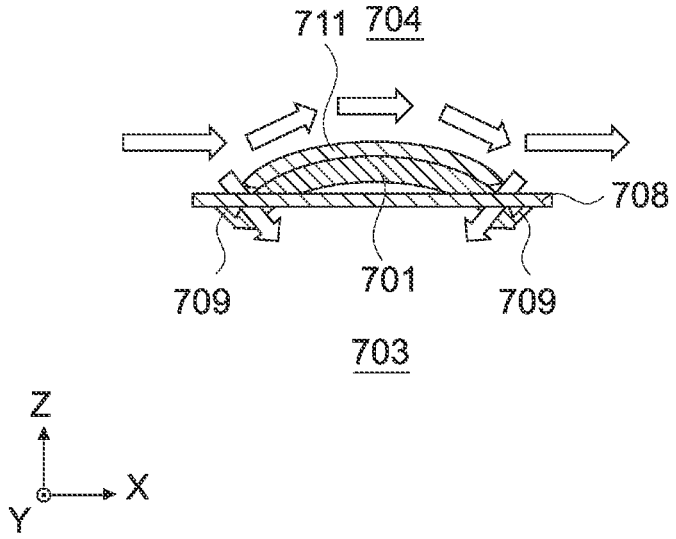
FIG. 41 is schematic diagrams showing a bent state of the movable portion included in the comparative fluid control apparatus.

FIG. 41 is a schematic diagram showing the fluid flow in the movable portion 701 bent and the fluid control apparatus 700 (arrows in FIG. 41). The fluid flows from the first space 703 to the second space 704 by bending the movable portion 701, a portion of the fluid as shown in FIG. 41 returns to the first space 703 via the gap 710, and a loss occurs.

Figure 42:
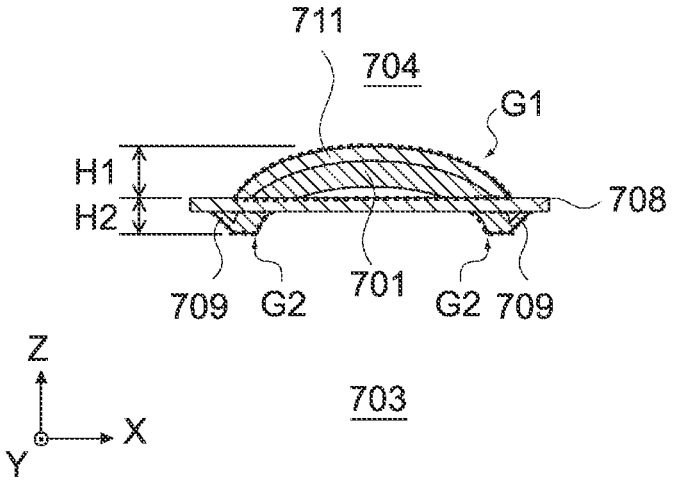
FIG. 42 is schematic diagrams showing the bent state of the movable portion included in the comparative fluid control apparatus.

FIG. 42 is a schematic diagram showing each region of the movable portion 701 in a bent state. As shown in FIG. 42, by bending the movable portion 701, a region G1 protrudes to a second space 704 side, which contributes to extrusion of the fluid. On the other hand, a region G2 is forced oppositely and protrudes to a first space 703 side, and does not contribute to the extrusion of the fluid.

Especially considering the operation above an audible range, it is structurally necessary to use a secondary resonance mode where the end of the movable portion 701 is forced oppositely, the region G2 which does not contribute to extrusion of the fluid is formed. In addition, a resonant mode of a lower order mode may occur simultaneously.

Figure 43:
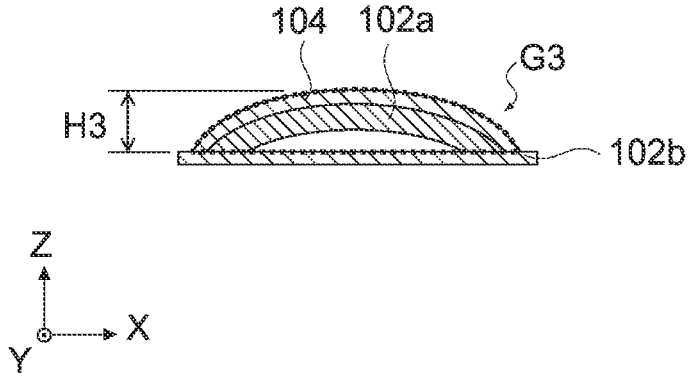
FIG. 43 is schematic diagrams showing a bent state of the movable portion included in the fluid control apparatus according to the embodiment of the present technology.

In contrast, the second housing member 102 included in the fluid control apparatus 100 operates as follows. FIG. 43 is a schematic diagram showing a region of the movable portion 102*a* in a bent state. As shown in FIG. 43, the entire movable portion 102*a* is a region G3 that contributes to the extrusion of the fluid.

In the second housing member 102, a gap is not provided between the fixed portion 102*b* and the movable portion 102*a*, or the gap is minimized such that passing the fluid through the gap is restricted and a loss is prevented. In addition, since no gap is provided or the gap is minimum, the rigidity of the spring portion 102*d* can be made larger than the rigidity of the spring portion 707, and a primary resonance mode can be shifted beyond the audible range. In addition, since the movable portion 102*a* is in a resonance mode in which an opposite force does not occur, efficient driving becomes possible.

[Other Configuration of Second Housing Member]

Figure 44:
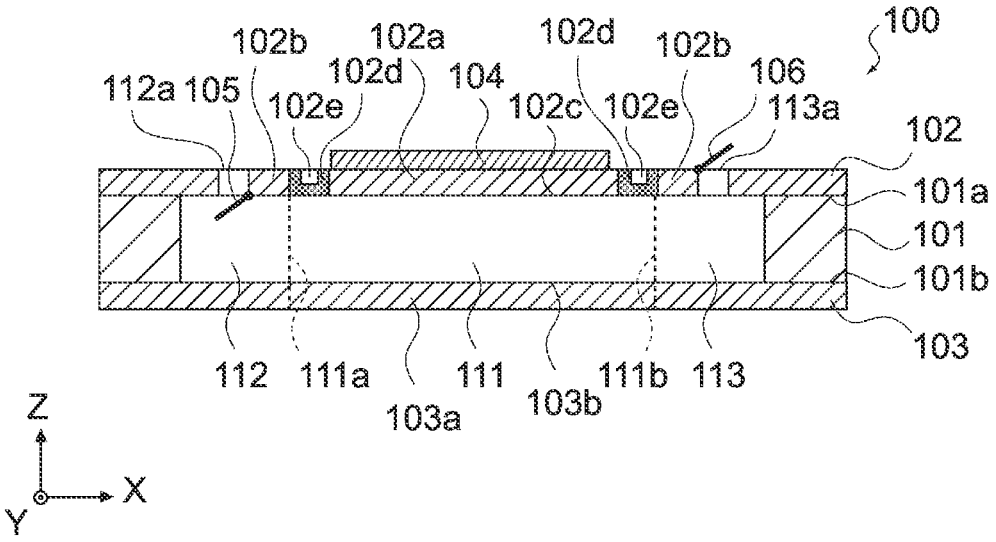
FIG. 44 is a cross-sectional diagram showing the spring portion having a concave portion included in the fluid control apparatus according to the embodiment of the present technology.
Figure 45:
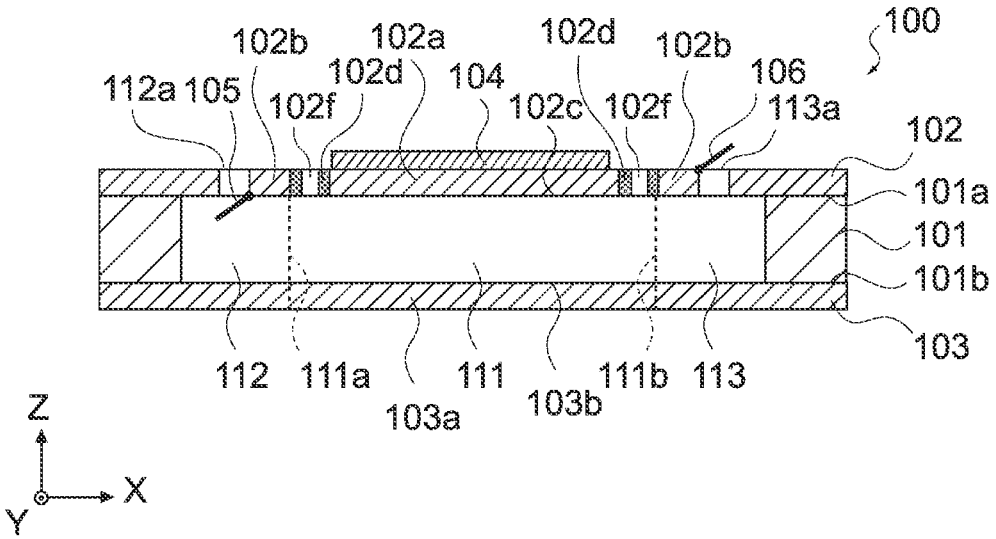
FIG. 45 is a cross-sectional diagram showing the spring portion having a gap included in the fluid control apparatus according to the embodiment of the present technology.
Figure 46:
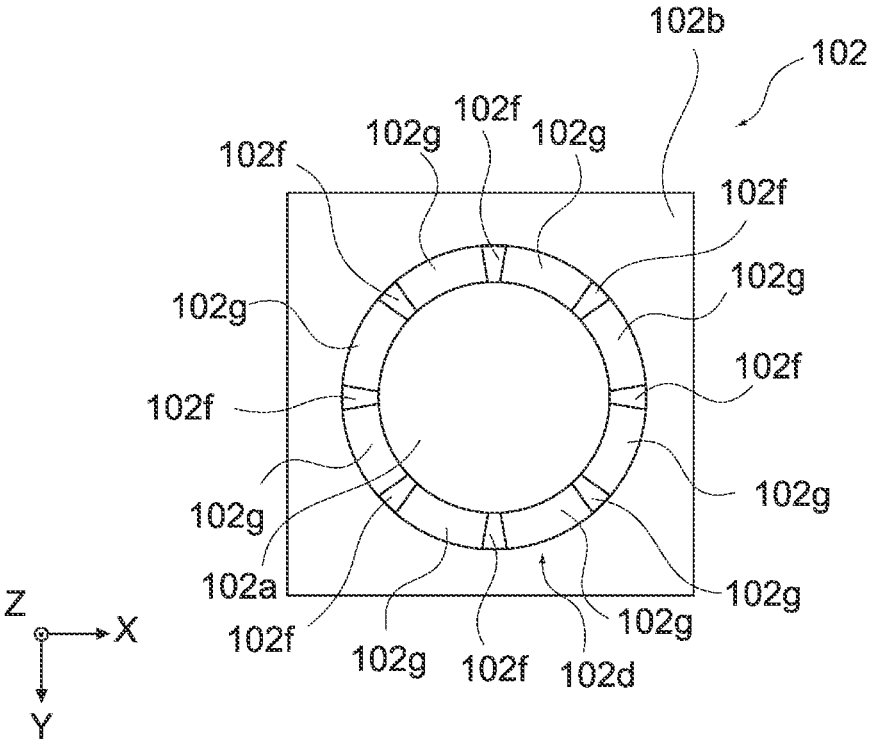
FIG. 46 is a cross-sectional diagram showing the spring portion having the gap included in the fluid control apparatus according to the embodiment of the present technology.

The second housing member 102 may further have the following configuration. FIGS. 44 to 46 are cross-sectional diagrams of the fluid control apparatus 100 including the second housing member 102 having respective configurations.

The spring portion 102*d* may have a concavo-convex structure. As shown in FIG. 44, the concavo-convex structure of the spring portion 102*d* includes a deformed spring structure in which a concave portion 102*e* is provided. In addition, the concavo-convex structure of the spring portion 102*d* may include a bellows structure, a waveform structure, or the like. By making the spring portion 102*d* have the concavo-convex structure, it is possible to adjust spring characteristics of the spring portion 102*d*.

Furthermore, as shown in FIG. 45, the spring portion 102*d* may have a gap 102*f*. FIG. 46 is a plan diagram of the second housing member 102 having the spring portion 102*d*. As shown in FIG. 46, the spring portion 102*d* includes a plurality of gaps 102*f* and a plurality of springs 102*g* arranged between the gaps 102*f*.

Here, a total area of the gaps 102*f* is formed to be equal to or less than a total area of the springs 102*g* viewed from the direction perpendicular to the second housing member 102 (Z direction). By making the total area of the gaps 102*f* equal to or less than the total area of the springs 102*g*, it is possible to reduce the amount of fluid passing through the gaps 102*f*. Note that the number of the spring portions 102*d* and the number of the gaps 102*f* are not limited to those shown in FIG. 46, and may be at least one or more.

The fluid control apparatus 100 including the second housing member 102 having each configuration was measured for a displacement amount. The measurement results are shown in the following Table 2.

TABLE 2

| | Comparative Example | Structure 1 | Structure 2 | Structure 3 |
|---|---|---|---|---|
| Maximum displacement [μ m] | 6.25 | 10.8 | 8.8 | 7.4 |
| Opposite force displacement [μ m] | −5.29 | 0 | 0 | 0 |
| Gap area [$mm^2$] | 9.02 | 0.81 | 0 | 0 |

In Table 2, "Comparative Example" has the diaphragm structure provided in the fluid control apparatus 700 (see FIG. 39), and the diameter of the elastic body is 9.3 mm. "Structure 1" has a structure of the second housing member 102 in which the gaps 102*f* (see FIG. 46) are provided in the spring portion 102*d*, and the diameter of the movable portion 102*a* is 9.3 mm.

"Structure 2" has a structure of the second housing member 102 including the spring portion 102*d* (see FIG. 38), and the diameter of the movable portion 102*a* is 9.6 mm. "Structure 3" has a structure of the second housing member 102 including the spring portion 102*d* (see FIG. 38), and the diameter of the movable portion 102*a* is 9.3 mm.

"Maximum displacement" is the displacement amount of the movable portion from the fixed portion (FIG. 42: displacement amount H1, FIG. 43: displacement amount H3). "Opposite force displacement" is the displacement amount of the spring portion in the direction opposite to the movable portion (FIG. 42: displacement amount H2). "Gap area" is the area of the gap provided in the spring portion (see FIGS. 39 and 46).

As shown in [Table 2], the opposite force displacement occurs in "Comparative Example", whereas the occurrence of the opposite force displacement is prevented in "Structure 1", "Structure 2", and "Structure 3".

[Other Configuration of Third Housing Member]

Figure 47:
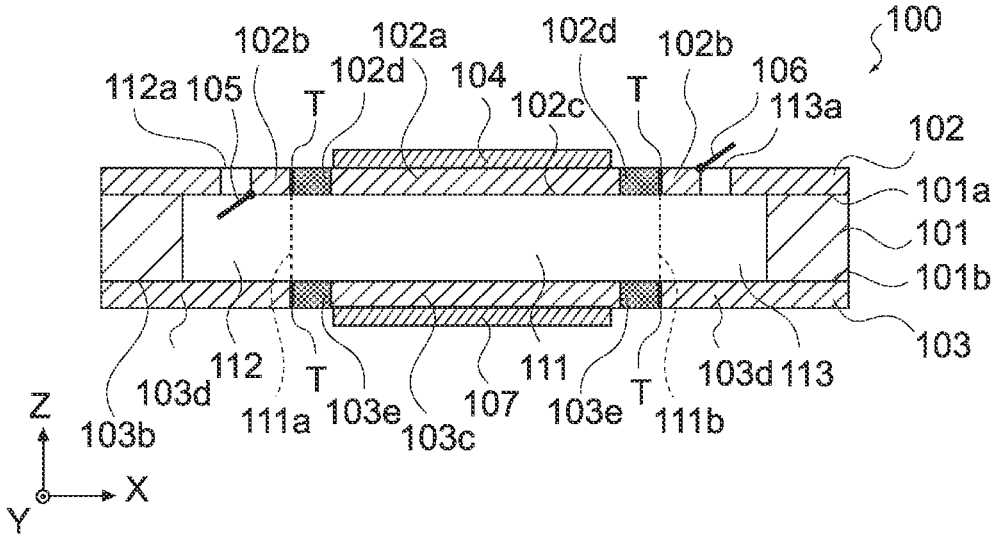
FIG. 47 is a cross-sectional diagram showing the movable portion arranged at both sides of the first space included in the fluid control apparatus according to the embodiment of the present technology.

The third housing member 103 may have the movable portion similar to the second housing member 102. FIG. 47 is a cross-sectional diagram of the fluid control apparatus 100 including the third housing member 103 having a movable portion 103*c*. As shown in FIG. 47, the third housing member 103 may include the movable portion 103*c*, a fixed portion 103*d*, and a spring portion 103*e*.

The movable portion 103*c* is positioned at the central portion of the third housing member 103 and is made of the elastic body. The fixed portion 103*d* is arranged around the movable portion 103*c* and is made of the inelastic body. The spring portion 103*e* is provided between the movable portion 103*c* and the fixed portion 103*d*. The spring portion 103*e* is different in rigidity from the movable portion 103*c*, and the end surface T positioned on the outer periphery of the spring portion 103*e* is fixed to the fixed portion 103*d*. The movable portion 103*c* and the spring portion 103*e* constitute the elastic body.

A drive mechanism 107, which is a piezoelectric element or the like, is provided on the movable portion 103*c*, and the movable portion 103*c* is configured to be bent by the drive mechanism 107 and functions as the diaphragm. The spring portion 103*e* may have various configurations as described above, similar to the spring portion 102*d*.

[Other Configuration of Drive Mechanism]

Figure 48:
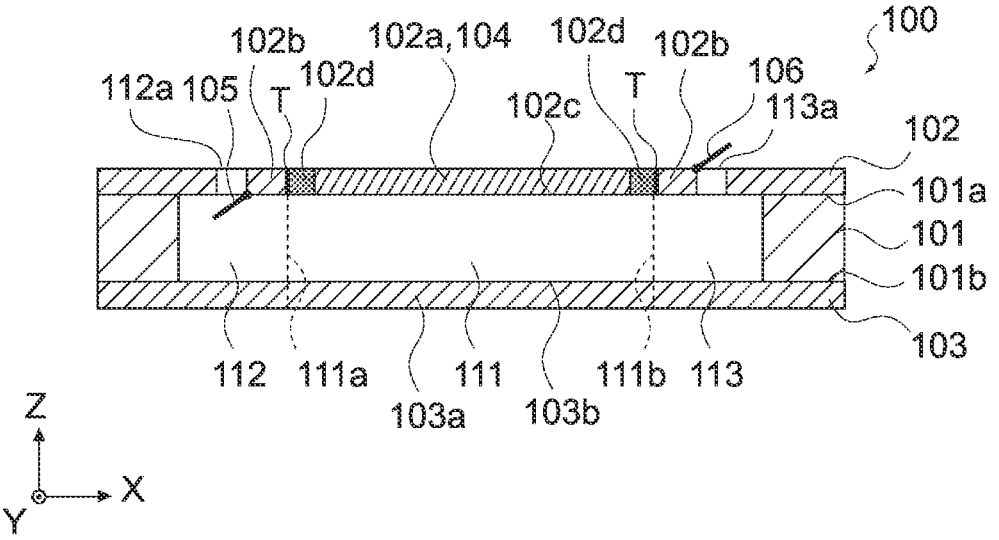
FIG. 48 is a cross-sectional diagram showing the movable portion also functioning as a drive mechanism included in the fluid control apparatus according to the embodiment of the present technology.
Figure 49:
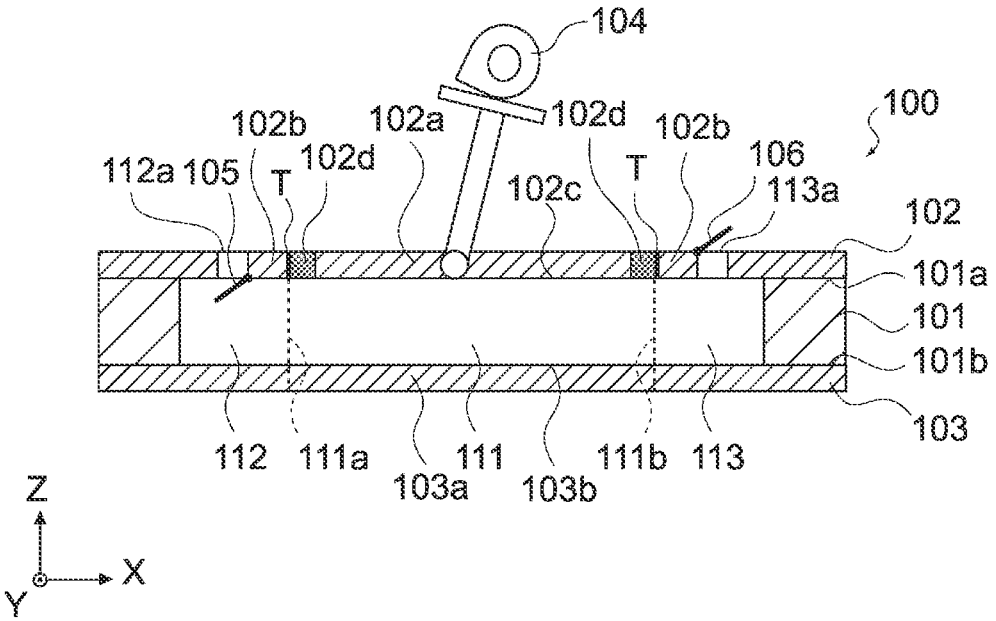
FIG. 49 is a cross-sectional diagram showing a mechanical drive mechanism included in the fluid control apparatus according to the embodiment of the present technology.

The drive mechanism 104 may have the following configuration. FIGS. 48 and 49 are cross-sectional diagrams of the fluid control apparatus 100 including the drive mechanism 104 having respective configurations.

As shown in FIG. 48, the movable portion 102*a* may be formed of the piezoelectric element, that is, the movable portion 102*a* may be formed integrally with the drive mechanism 104. As a result, the movable portion 102*a* can be bent by itself by driving the piezoelectric element.

Furthermore, as shown in FIG. 49, the drive mechanism 104 may be connected to the movable portion 102*a* to bend the movable portion 102*a* from the outside. As shown in FIG. 49, the drive mechanism 104 may bend the movable portion 102*a* by a mechanical mechanism, or may bend the movable portion 102*a* by another mechanism.

[Vibration Support Member]

Figure 50:
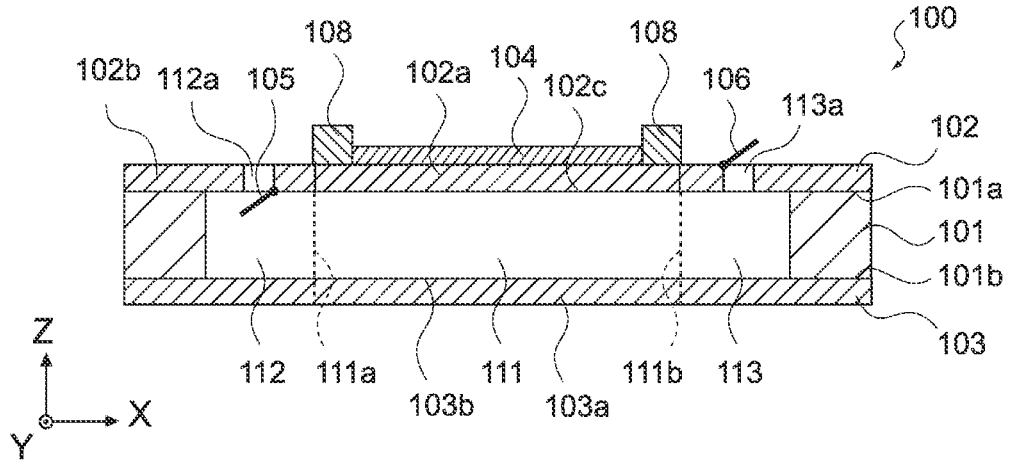
FIG. 50 is a cross-sectional diagram showing a vibration support included in the fluid control apparatus according to the embodiment of the present technology.
Figure 51:
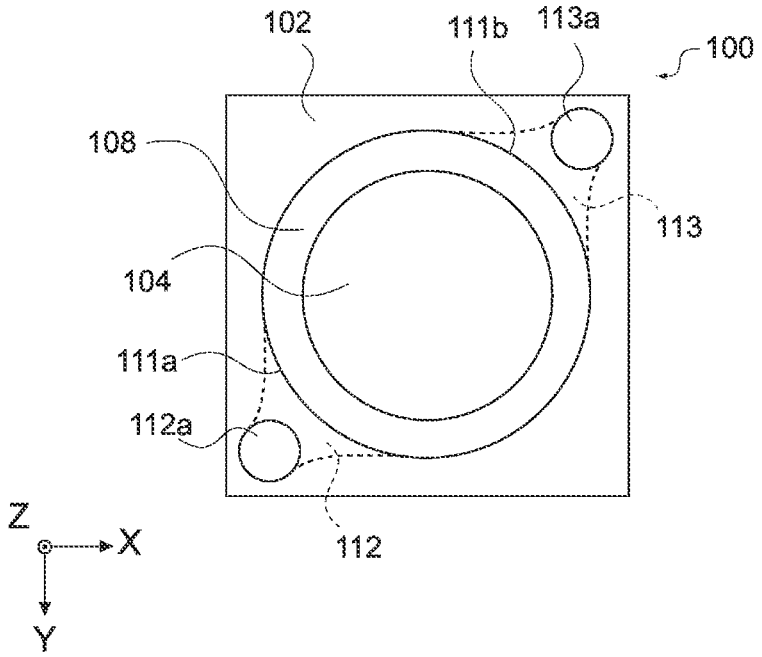
FIG. 51 is a cross-sectional diagram showing the vibration support included in the fluid control apparatus according to the embodiment of the present technology.

The fluid control apparatus 100 may include a vibration support member. FIG. 50 is a cross-sectional diagram of the fluid control apparatus 100 including a vibration support member 108, and FIG. 51 is a plan diagram of the fluid control apparatus 100. As shown in FIGS. 50 and 51, the vibration support member 108 may be an annular member which is bonded to the periphery of the drive mechanism 104 on the second housing member 102.

[Modification]

Figure 52:
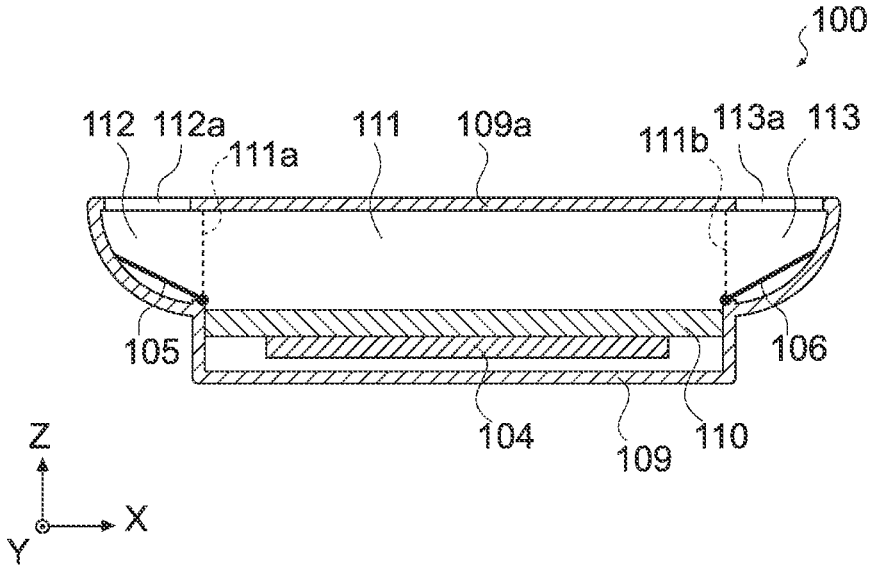
FIG. 52 is a cross-sectional diagram showing a fluid control apparatus according to a modification of the present technology.

The housing of the fluid control apparatus 100 in the above embodiments is constituted by laminating the first housing member 101, the second housing member 102, and the third housing member 103, but may be constituted of a single housing member. FIG. 52 is a cross-sectional diagram of the fluid control apparatus 100 including a single housing member. As shown in FIG. 52, the fluid control apparatus 100 includes a housing member 109, the movable portion 110, the drive mechanism 104, the first check valve 105, and the second check valve 106.

The movable portion 110 is bent by the drive mechanism 104 such as the piezoelectric element. The first space 111 is provided between an opposing portion 109*a*, which is a portion of the housing member 109 facing the movable portion 110, and the movable portion 110, and the second space 112 and the third space 113 are provided adjoined to the first space 111. Also in this configuration, the flow path resistance can be reduced by providing the suction port 112*a* and the discharge port 113*a* on the extension surface of the opposing portion 109*a* which is a flat plate member. Furthermore, between the movable portion 110 and the housing member 109, a spring portion having rigidity different from the movable portion 110 may be provided.

[Electronic Apparatus]

Applications of the fluid control apparatus 100 are not particularly limited, and can be mounted on the electronic apparatus, for example. The fluid control apparatus 100 can discharge air in the electronic apparatus to the outside or suck air from the outside of the electronic apparatus. Furthermore, the fluid control apparatus 100 can be utilized as a cooling device for suppressing heat generation by blowing the fluid to the heating element in the electronic apparatus. Since the fluid control apparatus 100 can be small-sized, it can be easily built into the electronic apparatus.

The present technology may also have the following structures.

(1)

A fluid control apparatus, including:

a first space having an inlet and an outlet;

two flat plate members facing each other via the first space, at least one of the flat plate members being an elastic body having flexibility;

a drive mechanism that bends the elastic body;

a second space that adjoins the first space, communicates with the first space via the inlet, and has a suction port;

a first check valve that allows fluid to flow from the suction port to the first space via the inlet;

a third space that adjoins the first space, communicates with the first space via the outlet, and has a discharge port; and a second check valve that allows the fluid to flow from the first space to the discharge port via the outlet, in which at least one of the suction port and the discharge port is positioned on an extension surface of at least one of the two flat plate members.

(2)

The fluid control apparatus according to (1), in which a volume of the first area is varied by bending the elastic body.

(3)

The fluid control apparatus according to (1) or (2), in which a flow path connected from the second space to the first space via the inlet and from the first space to the third space via the outlet has cross-sectional areas that continuously change in the first space, the second space, and the third space.

(4)

The fluid control apparatus according to any one of (1) to (3), in which the drive mechanism is a piezoelectric element, and the piezoelectric element is laminated on the elastic body.

(5)

The fluid control apparatus according to any one of (1) to (4), having a laminated structure in which a plurality of plate-shaped members are bonded.

(6)

The fluid control apparatus according to any one of (1) to (5), in which a housing of the fluid control apparatus has a polygon shape viewed from a direction perpendicular to the two flat plate members, the first space has a circular shape viewed from the direction perpendicular to the two flat plate members, and at least one of the suction port and the discharge port is arranged at a corner of the housing.

(7)

The fluid control apparatus according to (6), in which the second space forms a flow path using a curved surface extending from the suction port to the inlet from in a direction perpendicular to the extension surface of the two flat plate members to in a direction parallel to the extension surface, and the third space forms a flow path using a curved surface extending from the outlet to the discharge port from in the direction parallel to the extension surface to in the direction perpendicular to the extension surface.

(8)

The fluid control apparatus according to (7), in which the second check valve has a swing type structure and is in close contact to the curved surface of the third space when the valve is opened.

(9)

The fluid control apparatus according to any one of (1) to (8), in which when an area of the inlet is denoted as $S_A$ and an area of the outlet is denoted as $S_B$, $S_A<S_B$.

(10)

The fluid control apparatus according to (9), in which the fluid is air, and $S_A/S_B<0.3$.

(11)

The fluid control apparatus according to any one of (1) to (10), in which a part of the second space and a part of the third space are provided between the two flat plate members.

(12)

The fluid control apparatus according to any one of (1) to (11), in which the second space has cross-sectional areas of the flow path continuously changing from the suction port to the inlet, and the third space has cross-sectional areas of the flow path continuously changing from the outlet to the discharge port.

(13)

The fluid control apparatus according to any one of (1) to (12), including a plurality of the second spaces, a plurality of the third spaces, a plurality of the inlets, and a plurality of the outlets, in which a total area of the plurality of the inlets is smaller than a total area of the plurality of the outlets.

(14)

The fluid control apparatus according to (13), in which the largest area of the inlet among the plurality of the inlets is smaller than the smallest area of the outlet among the plurality of the outlets.

(15)

The fluid control apparatus according to any one of (9) to (14), in which the first space is formed such that the cross-sectional areas of the flow path continuously increase from the inlet to the outlet.

(16)

The fluid control apparatus according to any one of (1) to (15), in which the elastic body has a movable portion and a spring portion that has rigidity different from the movable portion and connects the movable portion to an outer periphery.

(17)

The fluid control apparatus according to (16), in which the movable portion and the spring portion are made of materials being different each other in rigidity.

(18)

The fluid control apparatus according to (16), in which the spring portion has a concavo-convex structure.

(19)

The fluid control apparatus according to any one of (16) to (18), in which the movable portion is formed integrally with the drive mechanism.

(20)

The fluid control apparatus according to any one of (16) to (18), in which the movable portion is bent by the drive mechanism connected to the movable portion.

(21)

The fluid control apparatus according to any one of (16) to (20), in which the spring portion has at least one gap and at least one spring, and a total area of the gap is equal to or less than a total area of the spring viewed from the direction perpendicular to the two flat plate members.

(22)

An electronic apparatus, including:

a fluid control apparatus, including a first space having an inlet and an outlet;

two flat plate members facing each other via the first space, at least one of the flat plate members being an elastic body having flexibility;

a drive mechanism that bends the elastic body;

a second space that adjoins the first space, communicates with the first space via the inlet, and has a suction port;

a first check valve that allows fluid to flow from the suction port to the first space via the inlet;

a third space that adjoins the first space, communicates with the first space via the outlet, and has a discharge port; and a second check valve that allows the fluid to flow from the first space to the discharge port via the outlet, in which at least one of the suction port and the discharge port is positioned on an extension surface of at least one of the two flat plate members.

REFERENCE SIGNS LIST

100 fluid control apparatus
101 first housing member
120 second housing member
102*a* movable portion
102*b* fixed portion
102*d* spring portion
103 third housing member
103*a* facing portion
104 drive mechanism
105 first check valve
106 second check valve
111 first space
111*a* inlet
111*b* outlet
112 second space
112*a* suction port
113 third space
113*a* discharge port

The invention claimed is:

1. A fluid control apparatus, comprising:

a first space having an inlet and an outlet, two fiat plate members facing each other via the first space, at least one of the fiat plate members being an elastic body having flexibility, a drive mechanism that bends the elastic body, a second space that adjoins the first space, communicates with the first space via the inlet, and has a suction port, a first check valve that allows fluid to flow from the suction port to the first space via the inlet, and a third space that adjoins the first space, communicates with the first space via the outlet, and has a discharge port, wherein at least one of the suction port and the discharge port is positioned on an extension surface of at least one of the two flat plate members, wherein a flow path is connected from the second space to the first space via the inlet and from the first space to the third space via the outlet, wherein the second space has cross-sectional areas of the flow path continuously changing from the suction port to the inlet, and wherein the third space has cross-sectional areas of the flow path continuously changing from the outlet to the discharge port.

2. The fluid control apparatus according to claim 1, wherein a volume of the first area is varied by bending the elastic body.

3. The fluid control apparatus according to claim 1, wherein the drive mechanism is a piezoelectric element, and the piezoelectric element is laminated on the elastic body.

4. The fluid control apparatus according to claim 1, having a laminated structure in which a plurality of plate-shaped members are bonded.

5. The fluid control apparatus according to claim 1, wherein a housing of the fluid control apparatus has a polygon shape viewed from a direction perpendicular to the two flat plate members, the first space has a circular shape Viewed from the direction perpendicular to the two flat plate members, and at least one of the suction port and the discharge port is arranged at a corner of the housing.

6. The fluid control apparatus according to claim 5, wherein the second space forms a flow path using a curved surface extending from the suction port to the inlet from in a direction perpendicular to the extension surface of the two flat plate members to in a direction parallel to the extension surface, and the third space forms a flow path using a curved surface extending from the outlet to the discharge port from in the direction parallel to the extension surface to in the direction perpendicular to the extension surface.

7. The fluid control apparatus according to claim 1, wherein when an area of the inlet is denoted as $S_A$ and an area of the outlet is denoted as $S_B$, $S_A<S_B$.

8. The fluid control apparatus according to claim 7, wherein the fluid is air, and $S_A/S_B<0.3$.

9. The fluid control apparatus according to claim 7, wherein a part of the second space and a part of the third space are provided between the two flat plate members.

10. The fluid control apparatus according to claim 1, including a plurality of the second spaces, a plurality of the third spaces, a plurality of the inlets, and a plurality of the outlets, wherein a total area of the plurality of the inlets is smaller than a total area of the plurality of the outlets .

11. The fluid control apparatus according to claim 10, wherein the largest area of the inlet among the plurality of the inlets is smaller than the smallest area of the outlet among the plurality of the outlets.

12. The fluid control apparatus according to claim 7, wherein the first space is formed such that the cross-sectional areas of the flow path continuously increase from the inlet to the outlet.

13. The fluid control apparatus according to claim 1, wherein the elastic body has a movable portion and a spring portion that has rigidity different from the movable portion and connects the movable portion to an outer periphery.

14. The fluid control apparatus according to claim 13, wherein the movable portion and the spring portion are made of materials being different each other in rigidity.

15. The fluid control apparatus according to claim 13, wherein the spring portion has a concavo-convex structure.

16. The fluid control apparatus according to claim 13, wherein the movable portion is formed integrally with the drive mechanism.

17. The fluid control apparatus according to claim 13, wherein the movable portion is bent by the drive mechanism connected to the movable portion.

18. The fluid control apparatus according to claim 13, wherein the spring portion has at least one gap and at least one spring, and a total area of the gap is equal to or less than a total area of the spring viewed from the direction perpendicular to the two flat plate members.

19. The fluid control apparatus according to claim 1, further comprising a second check valve that allows the fluid to flow from the first space to the discharge port via the outlet.

20. The fluid control apparatus according to claim 6, further comprising a second check valve that allows the fluid to flow from the first space to the discharge port via the outlet, wherein the second check valve has a swing type structure and is in close contact to the curved surface of the third space when the valve is opened.

21. An electronic apparatus, comprising:

a fluid control apparatus, including a first space having an inlet and an outlet;

two flat plate members facing each other via the first space, at least one of the flat plate members being an elastic body having flexibility, a drive mechanism that bends the elastic body, a second space that adjoins the first space, communicates with the first space via the inlet, and has a suction port, a first check valve that allows fluid to flow from the suction port to the first space via the inlet, and a third space that adjoins the first space, communicates with the first space via the outlet, and has a discharge port, wherein at least one of the suction port and the discharge port is positioned on an extension surface of at least one of the two flat plate members, wherein a flow path is connected from the second space to the first space via the inlet and from the first space to the third space via the outlet, wherein the second space has cross-sectional areas of the flow path continuously changing from the suction port to the inlet, and wherein the third space has cross-sectional areas of the flow path continuously changing from the outlet to the discharge port.

22. The electronic apparatus according to claim 21, further comprising a second check valve that allows the fluid to flow from the first space to the discharge port via the outlet.

23. A fluid control apparatus, comprising:

a first space having an inlet and an outlet;

two flat plate members facing each other via the first space, at least one of the flat plate members being an elastic body having flexibility;

a drive mechanism that bends the elastic body;

a second space that adjoins the first space, communicates with the first space via the inlet, and has a suction port;

a first check valve that allows fluid to flow from the suction port to the first space via the inlet; and a third space that adjoins the first space, communicates with the first space via the outlet, and has a discharge port, wherein at least one of the suction port and the discharge port is positioned on an extension surface of at least one of the two flat plate members, wherein a flow path connected from the second space to the first space via the inlet and from the first space to the third space via the outlet has cross-sectional areas that continuously change in the first space, the second space, and the third space.

24. An electronic apparatus comprising a fluid control apparatus according to claim 23.

* * * * *